US010864404B2

(12) United States Patent
Leipheimer

(10) Patent No.: US 10,864,404 B2
(45) Date of Patent: Dec. 15, 2020

(54) WEIGHT BENCH CENTERING DEVICE

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 239 days.

(21) Appl. No.: 15/420,539

(22) Filed: Jan. 31, 2017

(65) Prior Publication Data

US 2017/0216656 A1 Aug. 3, 2017

Related U.S. Application Data

(60) Provisional application No. 62/290,172, filed on Feb. 2, 2016.

(51) Int. Cl.

| | |
|---|---|
| ***A63B 21/00*** | (2006.01) |
| ***A63B 71/02*** | (2006.01) |
| ***A63B 23/035*** | (2006.01) |
| ***A63B 69/00*** | (2006.01) |
| ***A63B 21/062*** | (2006.01) |

(52) U.S. Cl.

CPC ..... *A63B 21/4029* (2015.10); *A63B 21/0628* (2015.10); *A63B 21/156* (2013.01); *A63B 23/03541* (2013.01); *A63B 69/0057* (2013.01); *A63B 71/023* (2013.01); *A63B 2210/50* (2013.01); *A63B 2225/09* (2013.01); *A63B 2225/093* (2013.01)

(58) Field of Classification Search

CPC ..... A63B 21/078

See application file for complete search history.

(56) References Cited

U.S. PATENT DOCUMENTS

| | | | | | |
|---|---|---|---|---|---|
| 4,635,934 | A * | 1/1987 | Roethke | A63B 21/154 | 482/104 |
| 4,749,190 | A * | 6/1988 | Jennings | A63B 23/00 | 482/104 |
| 5,082,259 | A * | 1/1992 | Gonzalez | A63B 23/0355 | 482/104 |
| 5,160,305 | A * | 11/1992 | Lin | A63B 23/00 | 482/138 |
| 5,316,528 | A * | 5/1994 | Ziparo | A63B 21/4029 | 482/142 |
| 5,350,346 | A * | 9/1994 | Martinez | A63B 21/078 | 482/104 |
| 7,147,594 | B1 * | 12/2006 | Vittone | A63B 21/078 | 482/142 |
| 7,204,791 | B1 * | 4/2007 | Baumler | A63B 21/00047 | 482/136 |
| 7,322,911 | B2 * | 1/2008 | Webber | A63B 23/02 | 482/142 |

(Continued)

*Primary Examiner* — Garrett K Atkinson

(74) *Attorney, Agent, or Firm* — The Webb Law Firm

(57) ABSTRACT

A centering device includes a receiving bracket configured to be attached to a bench unit including at least one wheel, the receiving bracket defines a receiving hole, and a catch mechanism configured to be attached to an exercise machine, the catch mechanism comprising at least one outer peg and a center peg, the outer peg defining a groove. The receiving bracket and wheels being engagable with the catch mechanism to center the bench unit with respect to the exercise machine.

9 Claims, 23 Drawing Sheets

(56) References Cited

U.S. PATENT DOCUMENTS

| | | | | |
|---|---|---|---|---|
| 7,331,912 | B2 * | 2/2008 | Keiser | A63B 21/4029 482/142 |
| 7,753,830 | B1 * | 7/2010 | Marsh | A63B 21/078 482/104 |
| 7,927,263 | B1 * | 4/2011 | Marsh | A63B 21/078 108/134 |
| 2005/0272574 | A1 * | 12/2005 | Lessard | A63B 21/078 482/104 |
| 2006/0217249 | A1 * | 9/2006 | Webber | A63B 23/02 482/142 |
| 2007/0225135 | A1 * | 9/2007 | Webber | A63B 23/02 482/140 |
| 2008/0076641 | A1 * | 3/2008 | Sheehan | A63B 21/0552 482/92 |
| 2014/0080685 | A1 * | 3/2014 | Butler | A63B 21/062 482/102 |
| 2018/0318635 | A1 * | 11/2018 | Lee | A63B 21/078 |

* cited by examiner

WEIGHT BENCH CENTERING DEVICE

CROSS REFERENCE TO RELATED APPLICATION

This application claims the benefit of U.S. Provisional Patent Application No. 62/290,172, filed on Feb. 2, 2016, the disclosure of which is incorporated in its entirety by reference.

BACKGROUND OF THE INVENTION

Field of the Invention

The invention generally relates to exercise machines and, specifically, to a centering device for centering and positioning a user support bench with an exercise machine.

Description of Related Art

Many multi-exercise machines (e.g., functional trainers, power racks, half racks, Smith machines, etc.) allow for users to perform various exercises. Some of these exercises require a user support bench, while others do not require a user support bench. For instance, some multi-exercise machines allow a user to perform a bench press exercise with a user support bench, but also allow a user to perform a squat exercise without a user support bench. In some instances, the multi-exercise machines have the user support bench detachable from the multi-exercise machine so that the user can perform the exercise not requiring the user support bench, free and clear of the user support bench.

There are at least certain exercises that can be performed using a multi-exercise machine that require that the user support bench be centered with the multi-exercise machine in order for the exercise to be performed safely and correctly. However, it is often difficult for a user to correctly, securely, and easily center the user support bench with the multi-exercise machine.

SUMMARY OF THE INVENTION

In one embodiment of the disclosure, a centering device includes a receiving bracket configured to be attached to a bench unit including at least one wheel, the receiving bracket defines a receiving hole, and a catch mechanism configured to be attached to an exercise machine, the catch mechanism comprising at least one outer peg and a center peg, the outer peg defining a groove. The receiving bracket and wheels being engagable with the catch mechanism to center the bench unit with respect to the exercise machine.

In another embodiment, the catch mechanism is linearly adjustable relative to the exercise machine. The at least one wheel of the bench unit includes two wheels. The at least one outer peg of the catch mechanism includes two outer pegs. During engagement of the catch mechanism with the receiving bracket, the receiving hole of the receiving bracket is configured to receive the center peg of the catch mechanism, and the at least one wheel of the bench unit is received in the groove of the at least one outer peg of the catch mechanism. The center peg of the catch mechanism is positioned more proximate the exercise machine than the at least one outer peg. The receiving hole of the receiving bracket includes a first portion with a first diameter and a second portion with a second diameter. The first diameter is smaller than the second diameter.

In another embodiment, an exercise machine and bench unit arrangement includes an exercise machine, a bench unit configured for removable connection to the exercise machine, and a centering device including a receiving bracket configured to be attached to a bench unit including at least one wheel, the receiving bracket defines a receiving hole, and a catch mechanism configured to be attached to an exercise machine, the catch mechanism comprising at least one outer peg and a center peg, the outer peg defining a groove. The receiving bracket and wheels are engagable with the catch mechanism to center the bench unit with respect to the exercise machine.

In another embodiment, the catch mechanism is linearly adjustable relative to the exercise machine. The at least one wheel of the bench unit includes two wheels. The at least one outer peg of the catch mechanism includes two outer pegs. During engagement of the catch mechanism with the receiving bracket, the receiving hole of the receiving bracket is configured to receive the center peg of the catch mechanism, and the at least one wheel of the bench unit is received in the groove of the at least one outer peg of the catch mechanism. The center peg of the catch mechanism is positioned more proximate the exercise machine than the at least one outer peg. The receiving hole of the receiving bracket includes a first portion with a first diameter and a second portion with a second diameter. The first diameter is smaller than the second diameter.

In another embodiment, a centering device includes a receiving bracket configured to be attached to a bench unit, the receiving bracket defining a receiving hole and at least one receiving slot, and a catch mechanism configured to be attached to an exercise machine, the catch mechanism comprising at least one outer peg and a center peg. The receiving bracket and catch mechanism being configured to engage one another to center the bench unit with respect to the exercise machine.

In another embodiment, the catch mechanism is linearly adjustable relative to the exercise machine. The at least one receiving slot of the receiving bracket comprises two receiving slots. The receiving slots are defined in opposing ends of the receiving bracket. The at least one outer peg of the catch mechanism comprises two outer pegs. The outer pegs extend from opposing ends of the catch mechanism. The at least one receiving slot of the receiving bracket includes a chamfered edge to guide the corresponding at least one outer peg of the catch mechanism into the at least one receiving slot. The at least one receiving slot of the receiving bracket is positioned more proximate to the bench unit than the receiving hole. The center peg of the catch mechanism is positioned more proximate the exercise machine than the at least one outer peg. During engagement of the receiving bracket with the catch mechanism, the at least receiving slot of the receiving bracket is configured to receive the at least one outer peg of the catch mechanism, and the receiving slot of the receiving bracket is configured to receive the center peg of the catch mechanism.

From the foregoing disclosure and the following more detailed description, it will be apparent to those skilled in the art that the present invention provides a significant advance in technology in the art of centering devices for positioning user support benches with an exercise machine.

DETAILED DESCRIPTION OF THE INVENTION

Figure 1:
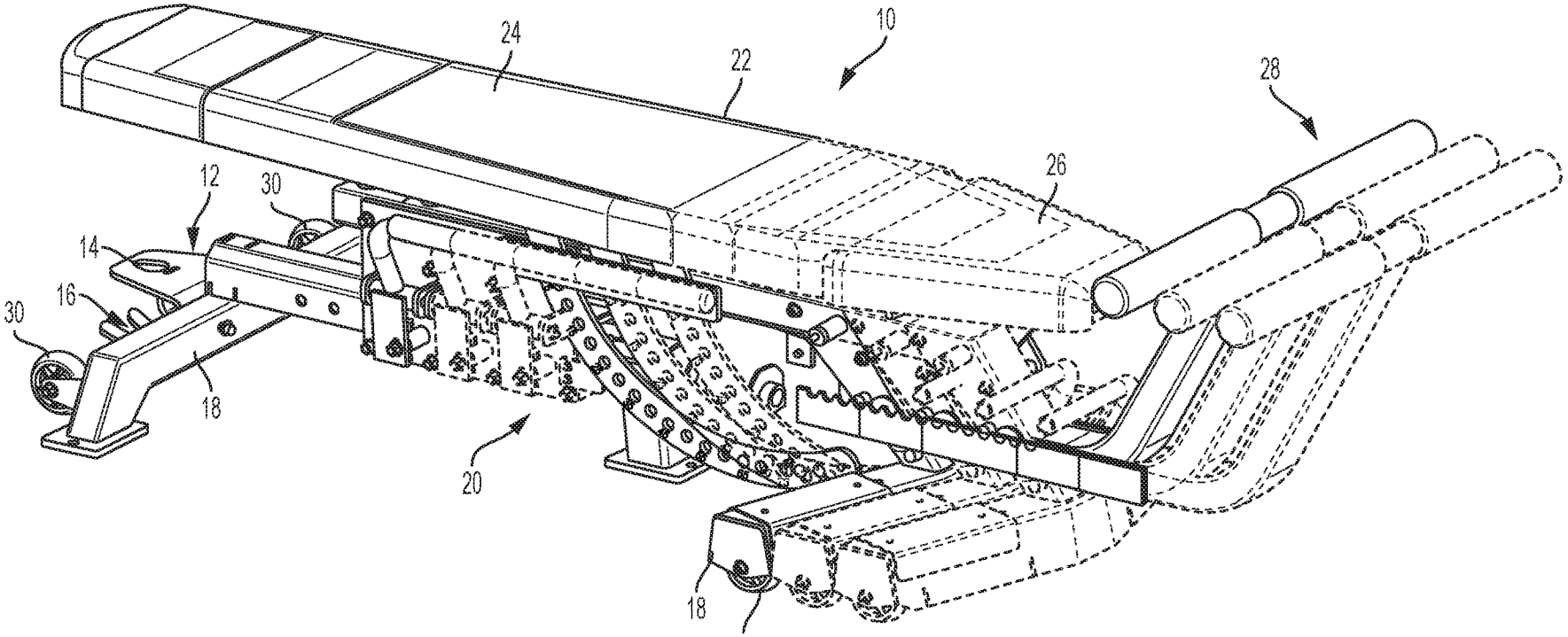
FIG. 1 is a front perspective view of a bench unit shown in several positions according to the present invention.

For the purposes of the description hereinafter, the terms "upper", "lower", "right", "left", "vertical", "horizontal", "top", "bottom", "side", "front", "back", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring to FIG. 1, a bench unit 10 includes a receiving bracket 12 attached thereto. The receiving bracket 12 defines a receiving hole 14 and defines at least one receiving slot 16. In one aspect, the receiving bracket 12 includes a plurality of receiving slots 16. In another aspect, the receiving bracket 12 includes two receiving slots 16. In one embodiment, the edges that define the receiving slots 16 include a chamfered portion to assist in guiding a peg of a catch mechanism (described below) into the receiving slot 16. The receiving bracket 12 is attached to the bench unit 10 by any typical arrangement known in the art, such as fasteners, including screws or bolts, welding, or integral molding with the bench unit 10. In the context of this specification, the terms "attached" and "connected" do not necessarily mean in direct contact, and can mean directly or indirectly in contact.

In one embodiment, the bench unit 10 includes a plurality of base bar units 18 and a cross bar unit 20. The cross bar unit 20 is positioned perpendicular to the base bar units 18 so as to connect the base bar units 18 with one another. A bench 22 is provided on the bench unit 10 and is positioned parallel to and above the cross bar unit 20. The bench 22 is a surface on which a user (e.g., one performing a weight-lifting exercise) may sit, lie, or stand. In some embodiments, the bench 22 is padded. The bench 22 can have sections, including a back pad 24 to support the back of a user lying on the bench 22 and a seat pad 26 to support the buttocks of a user sitting on the bench 22. The bench unit 10 also includes a foot unit 28 for a user to rest his/her feet while using the bench unit 10. The foot unit 28 extends past an end of the bench 22. The bench unit 10 includes wheels 30, which are attached to the base bar units 18. Different aspects of the bench unit 10 can be adjustable. For instance, the distance between the foot unit 28 and the bench 22 can be adjustable. The angle between the back pad 24 and the seat pad 26 can also be adjustable. In one instance, the angle between the back pad 24 and the seat pad 26 is 180°. When the angle is 180°, the bench 22 is configured for the user to lie on the bench 22. In another instance, the angle between the back pad 24 and the seat pad 26 is 90°. When the angle is 90°, the bench 22 is configured for the user to sit on the bench 22 with his/her back resting against the back pad 24. The angle between the back pad 24 and the seat pad 26 can also range between 90-180° to provide the user a reclined, seated position. The angle between the back pad 24 and the seat pad 26 can also be between 0-90° so the user is in a seated position leaning forward. The different positions of the back pad 24 relative to the seat pad 26 allow the user to select the appropriate position of the bench 22 for the particular exercise being performed. The bench 22 may also be horizontally adjustable, as shown in FIG. 1.

In one embodiment, the receiving bracket 12 is attached to a base bar unit 18 of the bench unit 10, such as by bolts or screws. In this embodiment, the receiving bracket 12 is proximate the wheels 30, which are also attached to the same base bar unit 18. The receiving bracket 12 is attached to the base bar unit 18 provided on the end of the back pad 24 opposite the seat pad 26. However, it is also contemplated that the receiving bracket 12 can also be attached to other parts of the bench unit 10.

Figure 2:
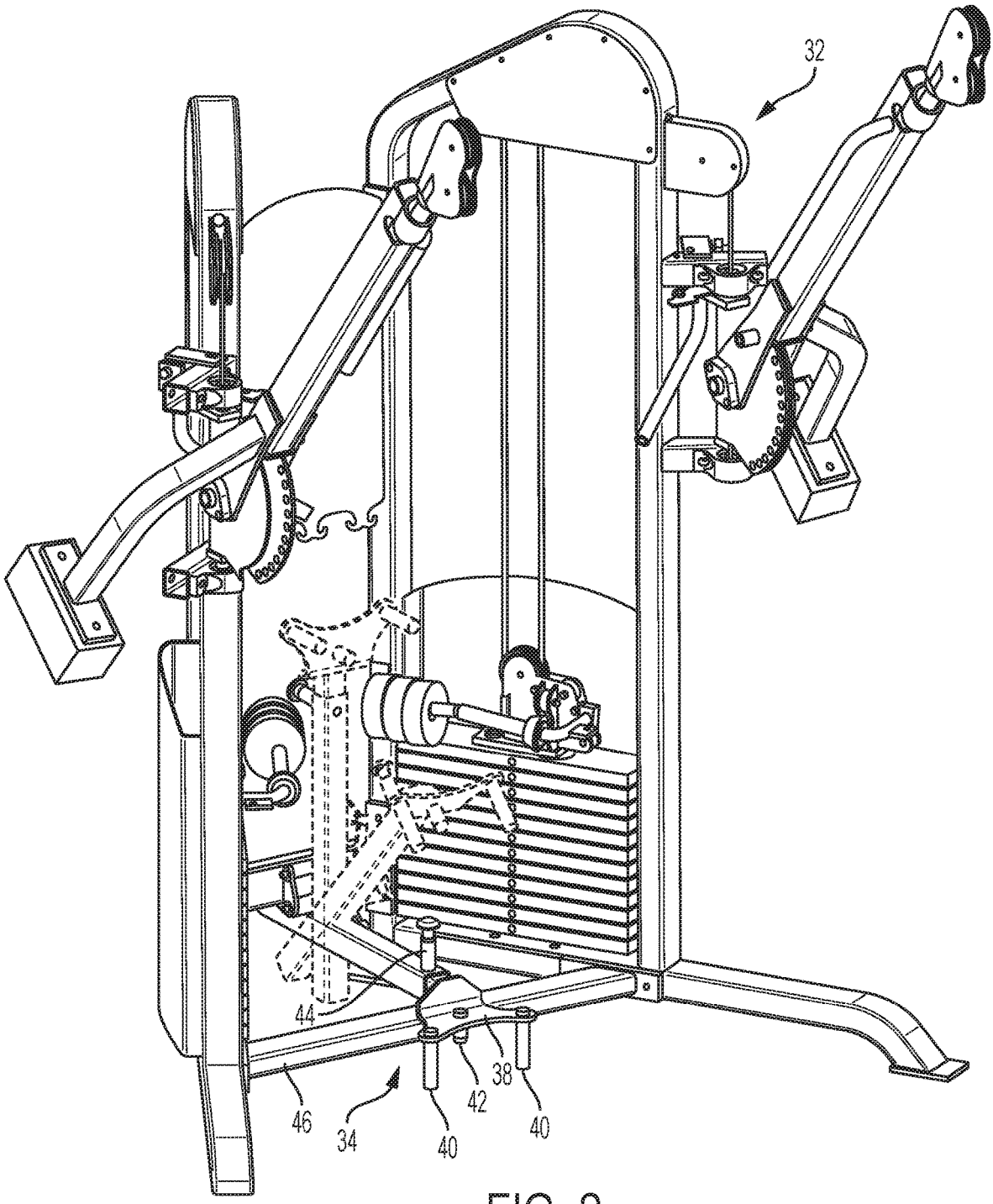
FIG. 2 is a front perspective view of an exercise machine having a catch mechanism according to the present invention with the catch mechanism shown in several different positions.

Referring to FIG. 2, an exercise machine 32 is provided. The exercise machine 32 can be any exercise machine, and in some non-limiting embodiments is a multi-exercise machine, such as a functional trainer, a power rack, a half rack, or a Smith machine. To the exercise machine 32 is attached a catch mechanism 34. The catch mechanism 34 is centered with the exercise machine 32. A bench unit 10 may be attached to the exercise machine 32 by a centering device, hereinafter described. The bench unit 10 is centered with the exercise machine 32 along a center line 36 (shown in FIGS. 7-9), which is an imaginary line along the center point of the exercise machine 32.

Figure 3:
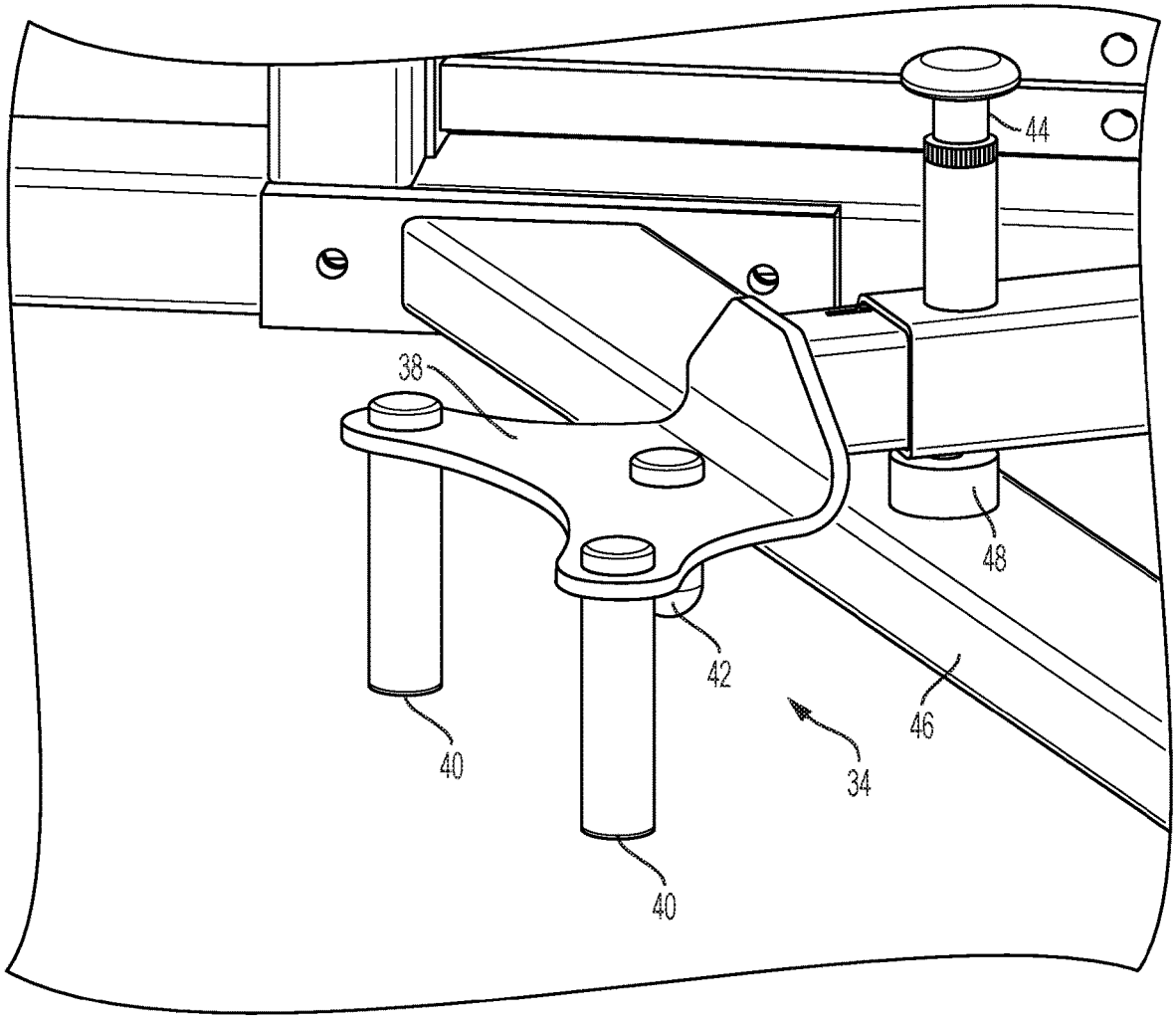
FIG. 3 is a front perspective view of a catch mechanism according to the present invention.
Figure 4:
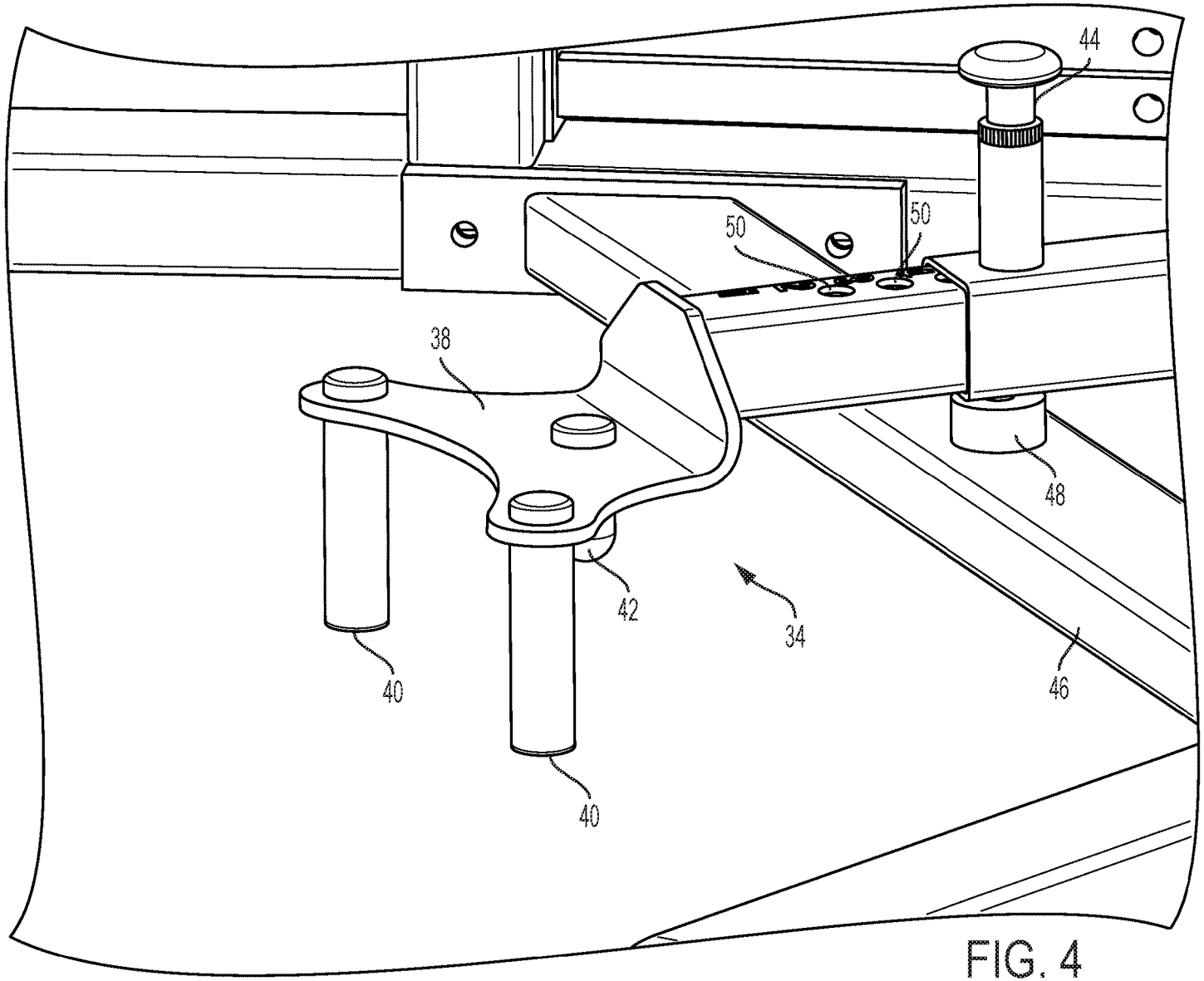
FIG. 4 is a rear perspective view of the catch mechanism of FIG. 3 that has been linearly adjusted.

Referring to FIGS. 2-4, the catch mechanism 34 includes a three point clamp 38. In one embodiment, the three point clamp 38 has a plurality of outside pegs 40 and a center peg 42. In one embodiment, such as the embodiment shown in FIGS. 2-4, the catch mechanism 34 has two outside pegs 40. The outside pegs 40 may be located farther from the exercise machine 32 than the center peg 42. However, the outside pegs 40 do not need to be located farther from the exercise machine 32 than the center peg 42. For instance, the outside pegs 40 and the center peg 42 may be located at the same distance from the exercise machine 32 in an embodiment in which the receiving bracket 12, the receiving hole 14, and the receiving slots 16 are on a different plane, causing the corresponding components to engage as the bench unit 10 is lowered.

In certain embodiments, an adjuster knob 44 is provided to attach the catch mechanism 34 to the exercise machine 32. The adjuster knob 44 allows the catch mechanism 34 to be linearly adjustable relative to the exercise machine 32. To linearly adjust the distance between the catch mechanism 34 and the exercise machine 32, the user can pull up on the adjuster knob 44 and then linearly slide the catch mechanism 34, either in the direction toward or away from the exercise machine 32. FIG. 3 shows the position in which the catch mechanism 34 and the exercise machine 32 are most proximate. FIG. 4 shows the catch mechanism 34 being progressively linearly adjusted away from the exercise machine 32. As shown in FIG. 4, the adjuster knob 44 can rest in a plurality of different catch mechanism adjuster holes 50 to maintain the distance between the catch mechanism 34 and the exercise machine 32, once the user has determined the desired distance. Other embodiments to adjust this distance are also contemplated other than using catch mechanism adjuster holes 50, such as using a continuous, slideable groove, into which the adjuster knob 44 can fit, to maintain the distance between the catch mechanism 34 and the exercise machine 32 once the user has determined the desired distance.

Referring back to FIG. 2, the catch mechanism 34 can be lifted and lowered. In the fully lifted position, the catch mechanism 34 is vertical. In the fully lowered position, the catch mechanism 34 is horizontal and rests on a stopper 48 (see FIG. 3) on an exercise machine base bar 46. The catch mechanism 34 can be lifted and lowered between the fully lowered position and the fully lifted position, as shown in FIG. 2. This allows for more space in the area of the exercise machine 32 when performing exercises without a bench unit 10.

Figure 5:
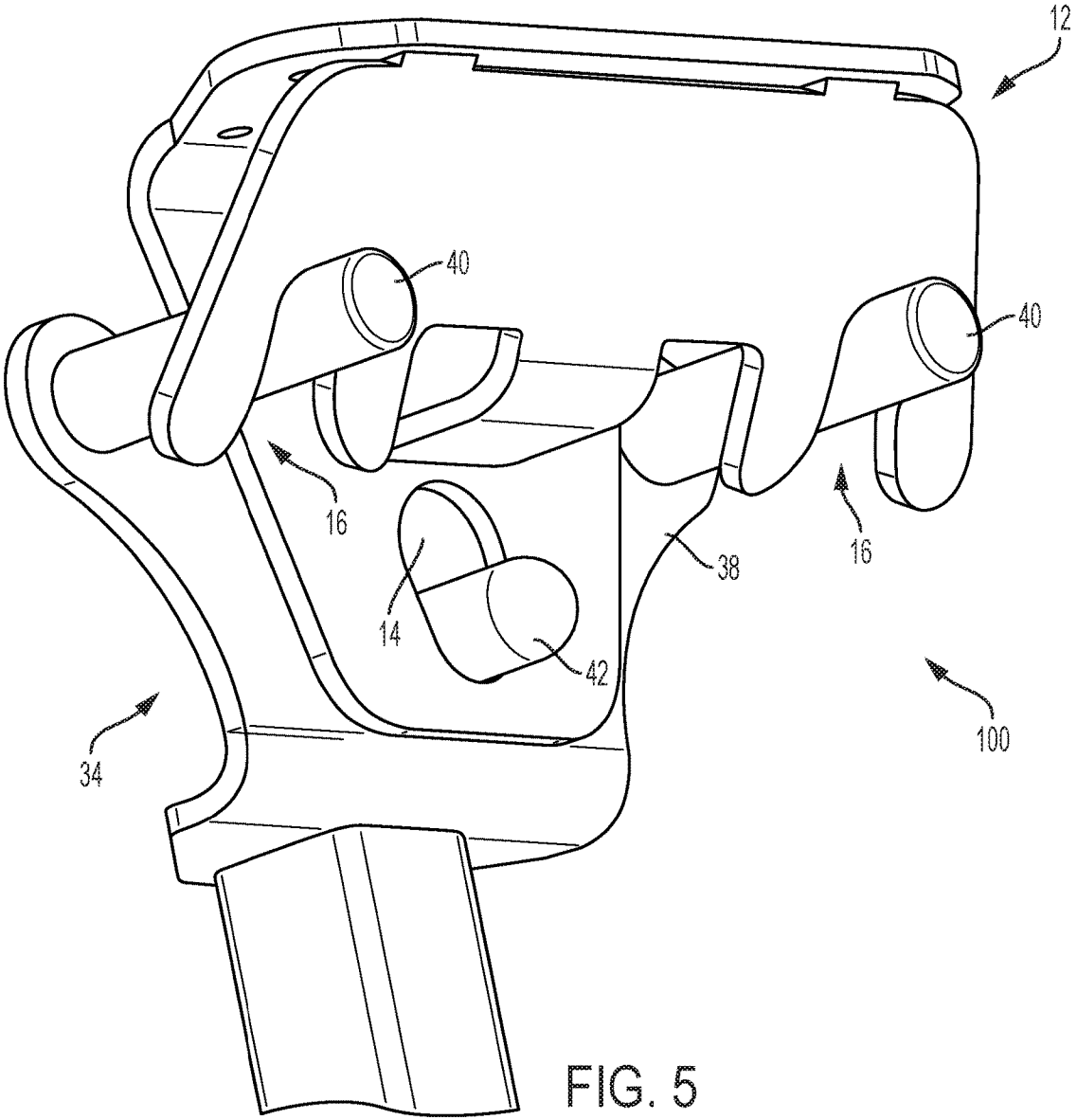
FIG. 5 is a bottom perspective view of the catch mechanism of FIG. 3 and a centering device according to the present invention.
Figure 6:
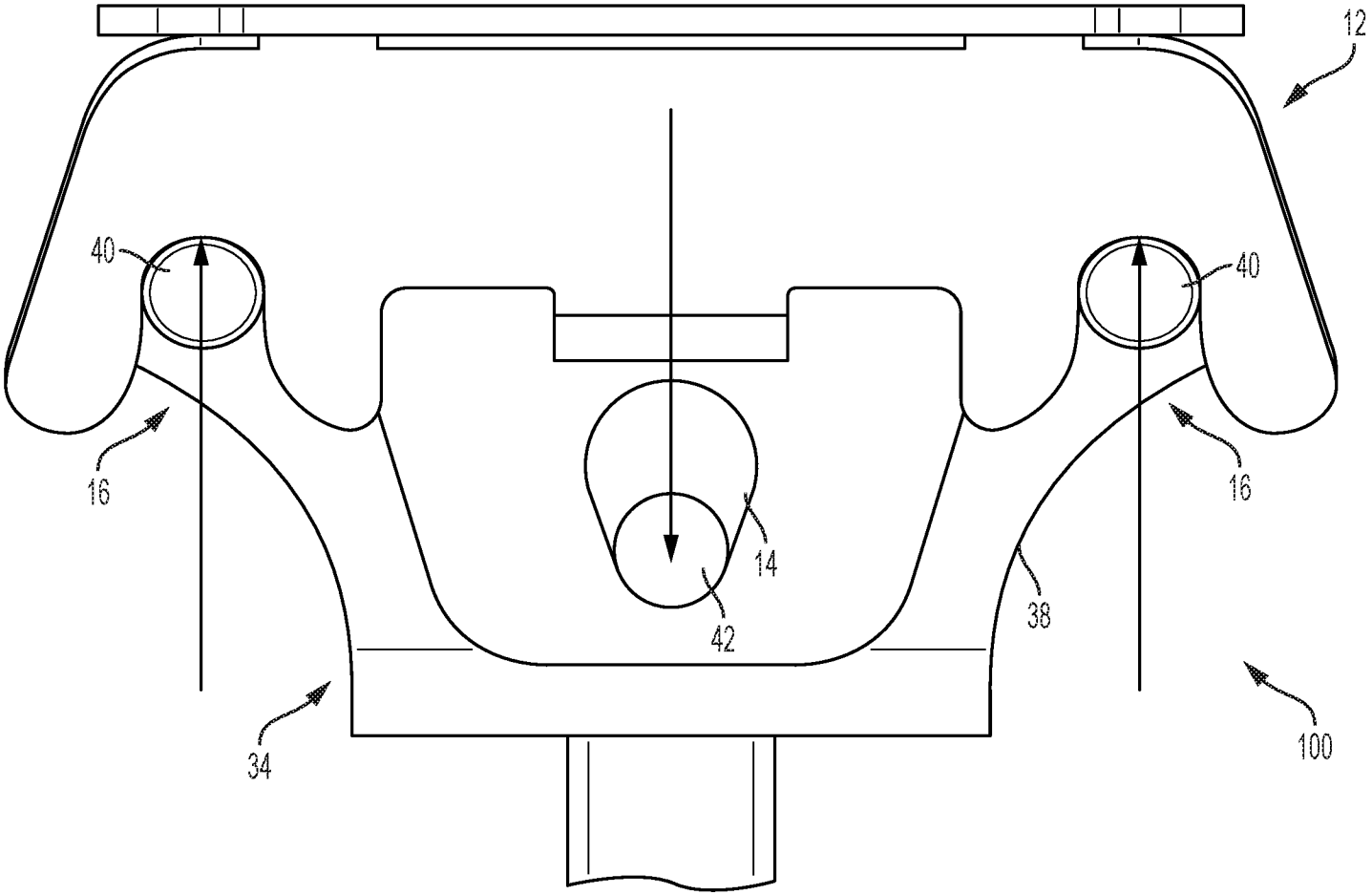
FIG. 6 is a bottom view of the catch mechanism and the centering device of FIG. 5.

Referring to FIGS. 5 and 6, a centering device 100 allows a user to center and position a bench unit 10 (not shown) with an exercise machine 32 (not shown). The centering device 100 is formed by the receiving bracket 12 and the catch mechanism 34. In one embodiment of the centering device 100, the receiving bracket 12 defines a receiving hole 14. The receiving hole 14 is rounded, with a rounded section having a larger diameter closer to the bench unit 10 and another rounded section having a smaller diameter farther away from the bench unit 10 (see FIG. 5). The receiving bracket 12 also defines a plurality of receiving slots 16. Two receiving slots 16 are shown in the embodiment of FIGS. 5 and 6. The receiving slots 16 have a rounded end configured to receive a rounded peg. The receiving bracket 12, in this embodiment, also has a mounting face to screw or bolt, for instance, the receiving bracket 12 to the bench unit 10. In this embodiment, the catch mechanism 34 includes a three point clamp 38, which has a plurality of outside pegs 40 (two as shown in FIG. 5), and a center peg 42. In this embodiment, the center peg 42 is located closer to the exercise machine 32 than the plurality of outside pegs 40, but this is not always the case, as previously discussed. The catch mechanism 34 and the receiving bracket 12 of the centering device 100 engage one another to center the bench unit 10 with the exercise machine 32. The engagement of the catch mechanism 34 and the receiving bracket 12 results in a centered bench unit 10 along the center line 36 of the exercise machine 32 because the catch mechanism 34 is attached in a centered position with the exercise machine 32. To engage the catch mechanism 34 and the receiving bracket 12, the outside pegs 40 of the catch mechanism 34 fit into the rounded end of the corresponding receiving slots 16 of the receiving bracket 12. Further, the center peg 42 of the catch mechanism 34 is inserted into the receiving hole 14 of the receiving bracket 12.

Referring specifically to FIG. 6, this configuration is advantageous for attaching the bench unit 10 to the exercise machine 32 because it provides a secure connection between the bench unit 10 and the exercise machine 32. As shown in FIG. 6, the engagement of the catch mechanism 34 and the receiving bracket 12 results in a force that pushes the outside pegs 40 into the rounded end of the receiving slots 16 (in the direction of the bench unit 10). The engagement of the catch mechanism 34 and the receiving bracket 12 simultaneously results in a force that pushes the center peg 42 into the section of the receiving hole 14 having a smaller diameter, which is in the direction of the exercise machine 32 (opposite the direction of the force acting on the outside pegs 40). This configuration provides a secure connection of the bench unit 10 and the exercise machine 32, which is also centered with the exercise machine 32 because of the position of the catch mechanism 34. This configuration, where the two outside pegs 40 clamp in one direction and the center peg 42 clamps in the opposite direction, straightens and centers the bench unit 10.

Figure 7:
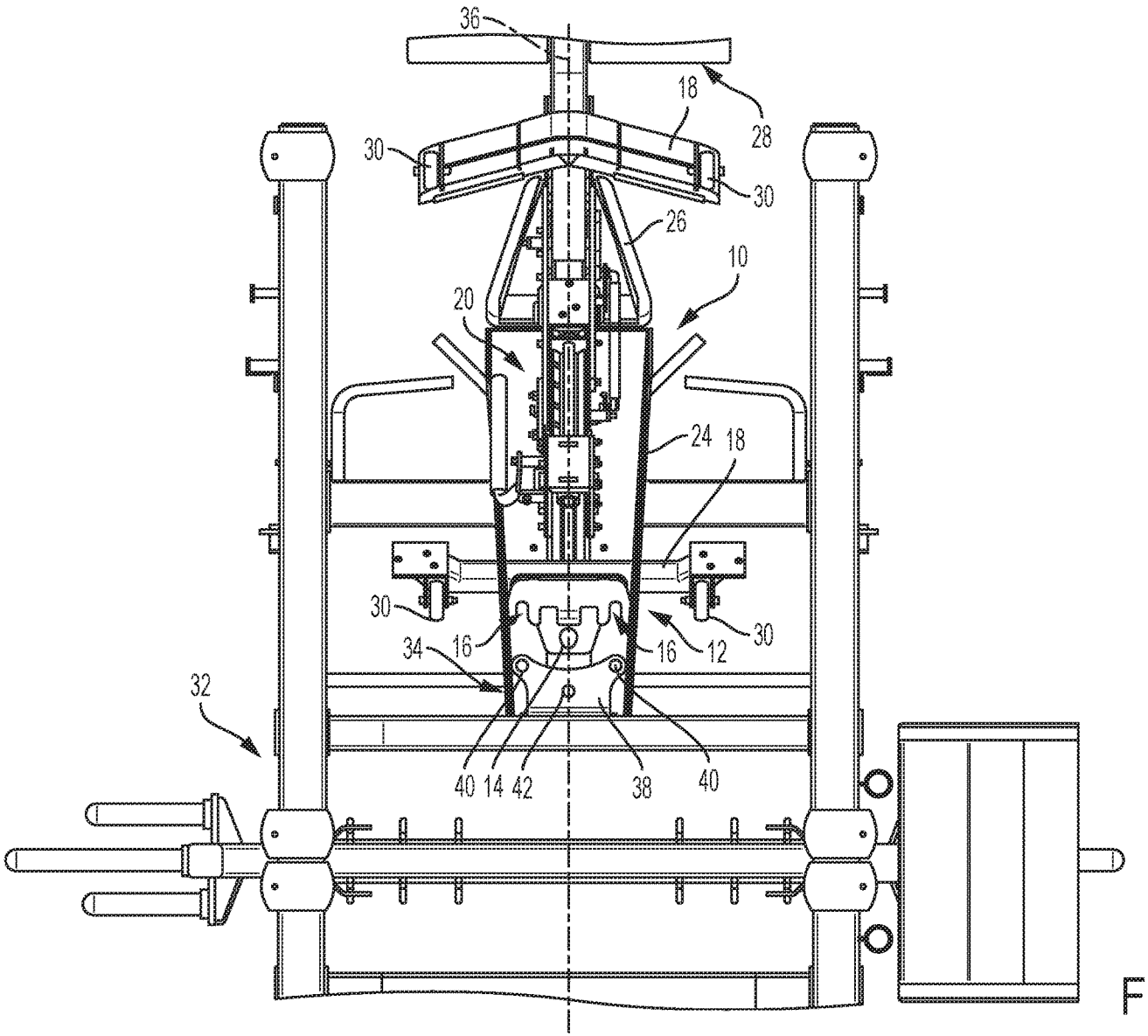
FIG. 7 is a bottom view of a bench unit fully disengaged with an exercise machine according to the present invention.
Figure 8:
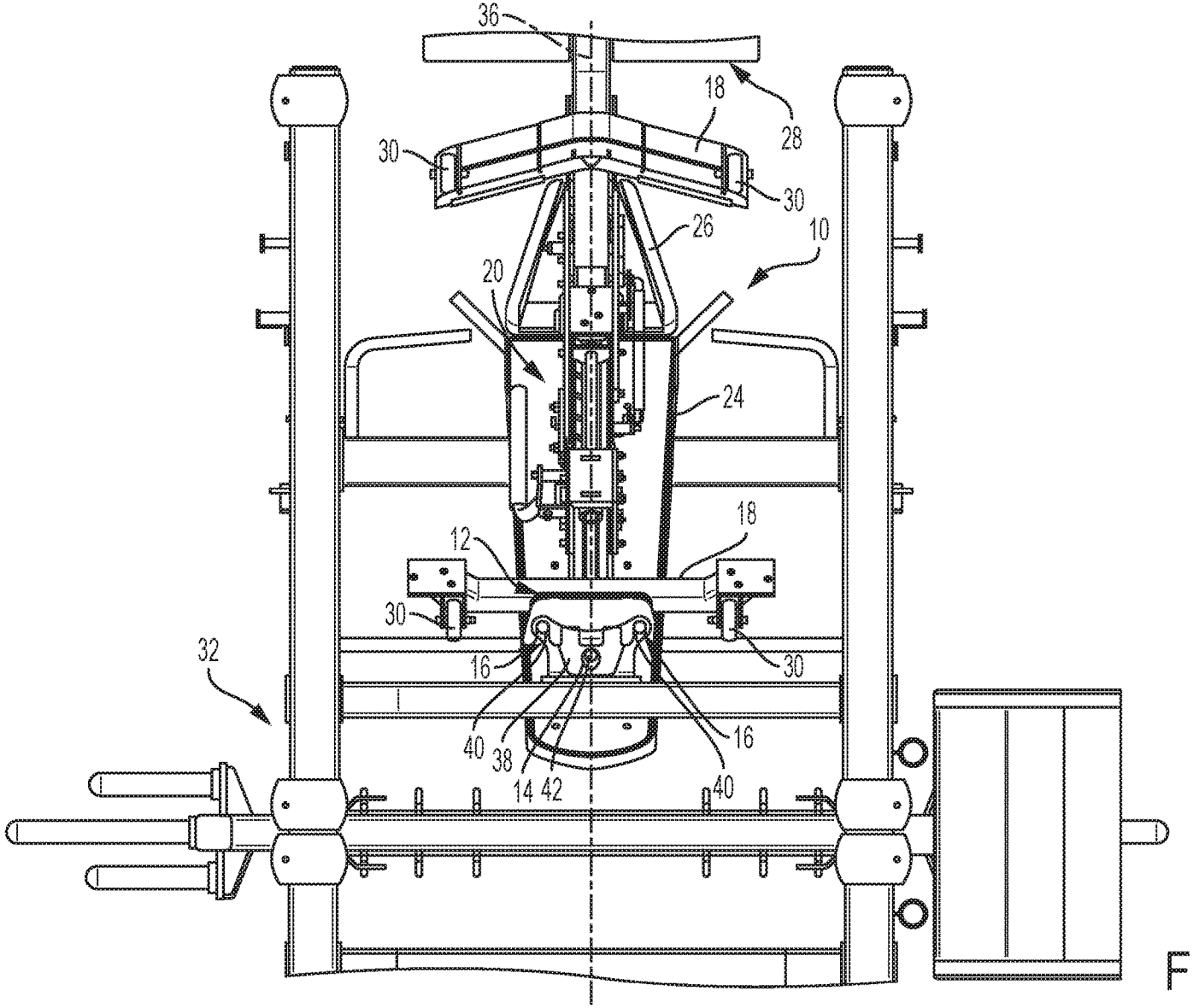
FIG. 8 is a bottom view of the bench unit of FIG. 7 partially engaged with the exercise machine.
Figure 9:
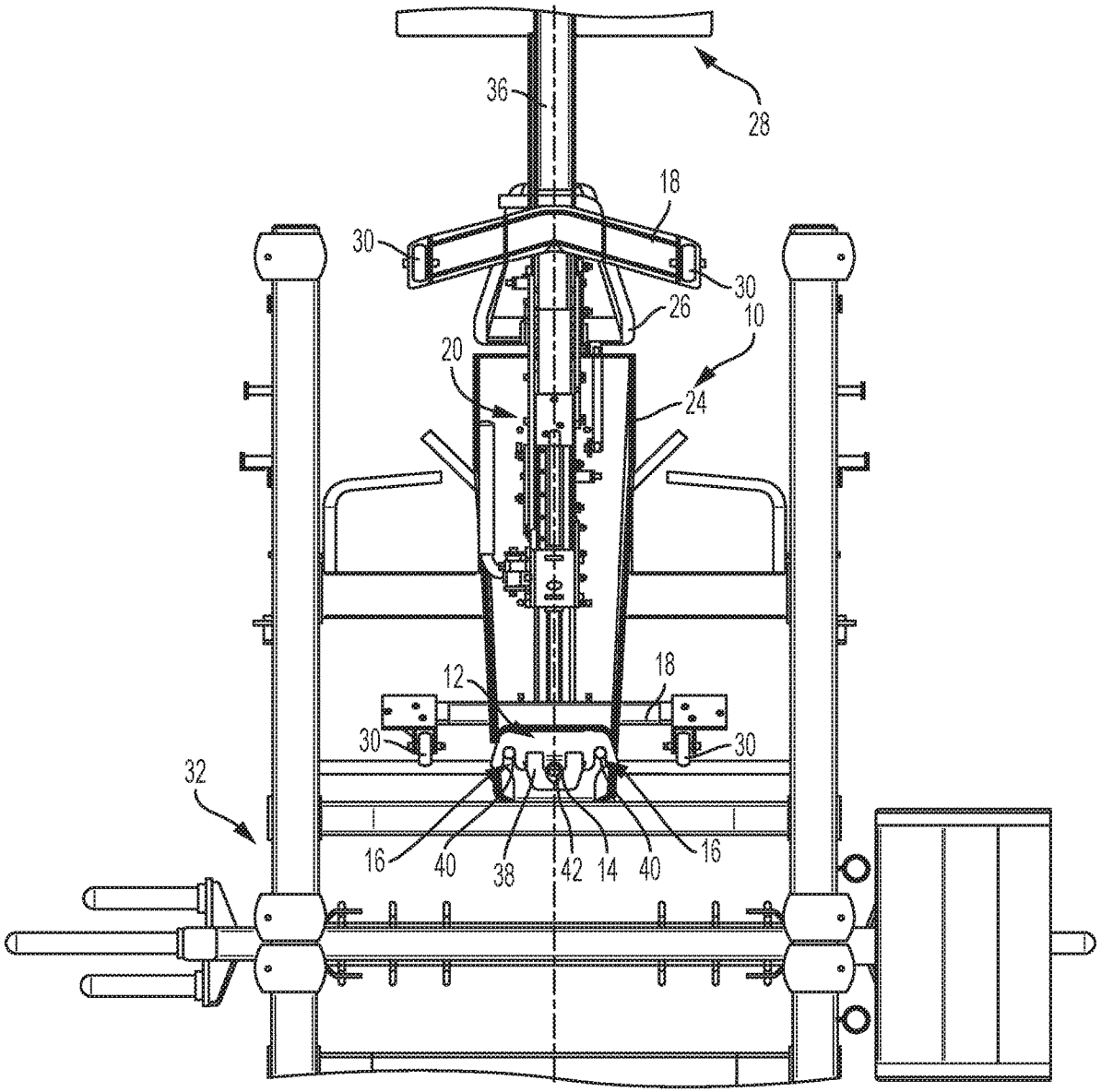
FIG. 9 is a bottom view of the bench unit of FIG. 7 fully engaged with the exercise machine.

FIGS. 7-9 show a bottom view of the receiving bracket 12 and the catch mechanism 34 going from being disengaged to being engaged. In FIG. 7, the receiving bracket 12 and the catch mechanism 34 are fully disengaged, as there is a gap between each of the compatible parts of the receiving bracket 12 and the catch mechanism 34. In FIG. 8, the receiving bracket 12 and the catch mechanism 34 are partially engaged. The bench unit 10 has been moved using the wheels 30 towards the catch mechanism 34 to transition from the fully disengaged position in FIG. 7 to the partially engaged position in FIG. 8. This is done by lifting one end of the bench unit 10 opposite the receiving bracket 12 so that the wheels 30 proximate the receiving bracket 12 are in contact with the ground to roll the bench unit 10 towards the catch mechanism 34. As shown in FIG. 8, the outside pegs 40 of the catch mechanism 34 are in contact with the rounded end portion of their respective receiving slots 16 of the receiving bracket 12. The outside pegs 40 entering the receiving slots 16 help guide the bench unit 10 to a centered position, as the rounded ends of the receiving slots 16 are configured to engage with the outside pegs 40. The center peg 42 of the catch mechanism 34 is shown over the larger rounded portion of the receiving hole 14 of the receiving bracket 12 closer to the bench unit 10. Finally, FIG. 9 shows the receiving bracket 12 and the catch mechanism 34 in the fully engaged position. Like in FIG. 8, the outside pegs 40 of the catch mechanism 34 are in contact with the rounded end portion of their respective receiving slots 16 of the receiving bracket 12. However, in the fully engaged position, the center peg 42 of the catch mechanism 34 is shown inserted into the receiving hole 14 of the receiving bracket 12, and the center peg 42 is in contact with the rounded portion of the receiving hole 14 farther from the bench unit 10 (the portion having the smaller diameter). The center peg 42 and the receiving hole 14 move from the partially engaged configuration in FIG. 8 to the fully engaged position in FIG. 9 by lowering the end of the bench unit 10 that was previously lifted. This lowering causes the center peg 42 to engage the receiving hole 14, which means that the center peg 42 is fully inserted into the receiving hole 14 and is in contact with the smaller diameter rounded end of the receiving hole 14.

Figure 10:
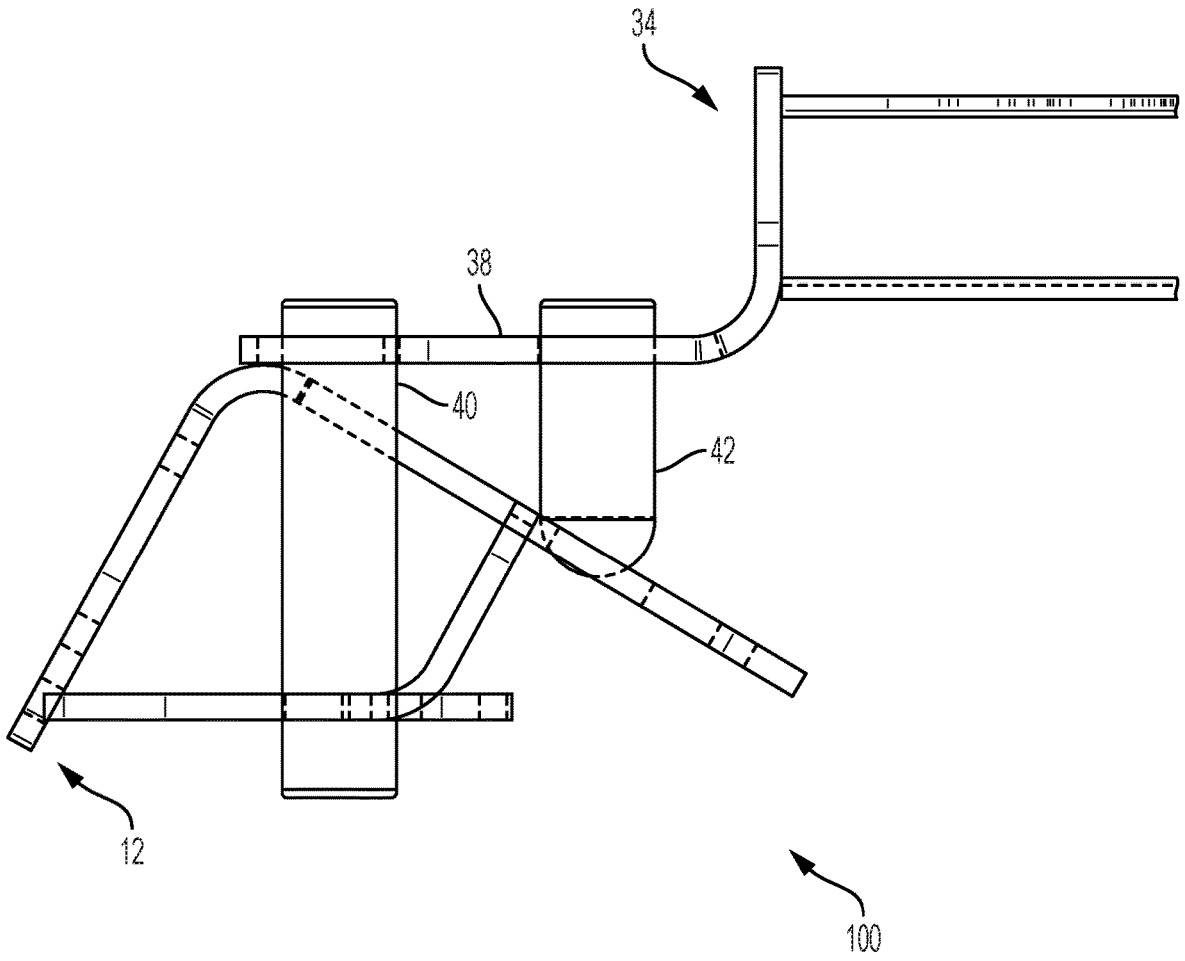
FIG. 10 is a side view of a catch mechanism partially engaged with a receiving bracket according to the present invention.
Figure 11:
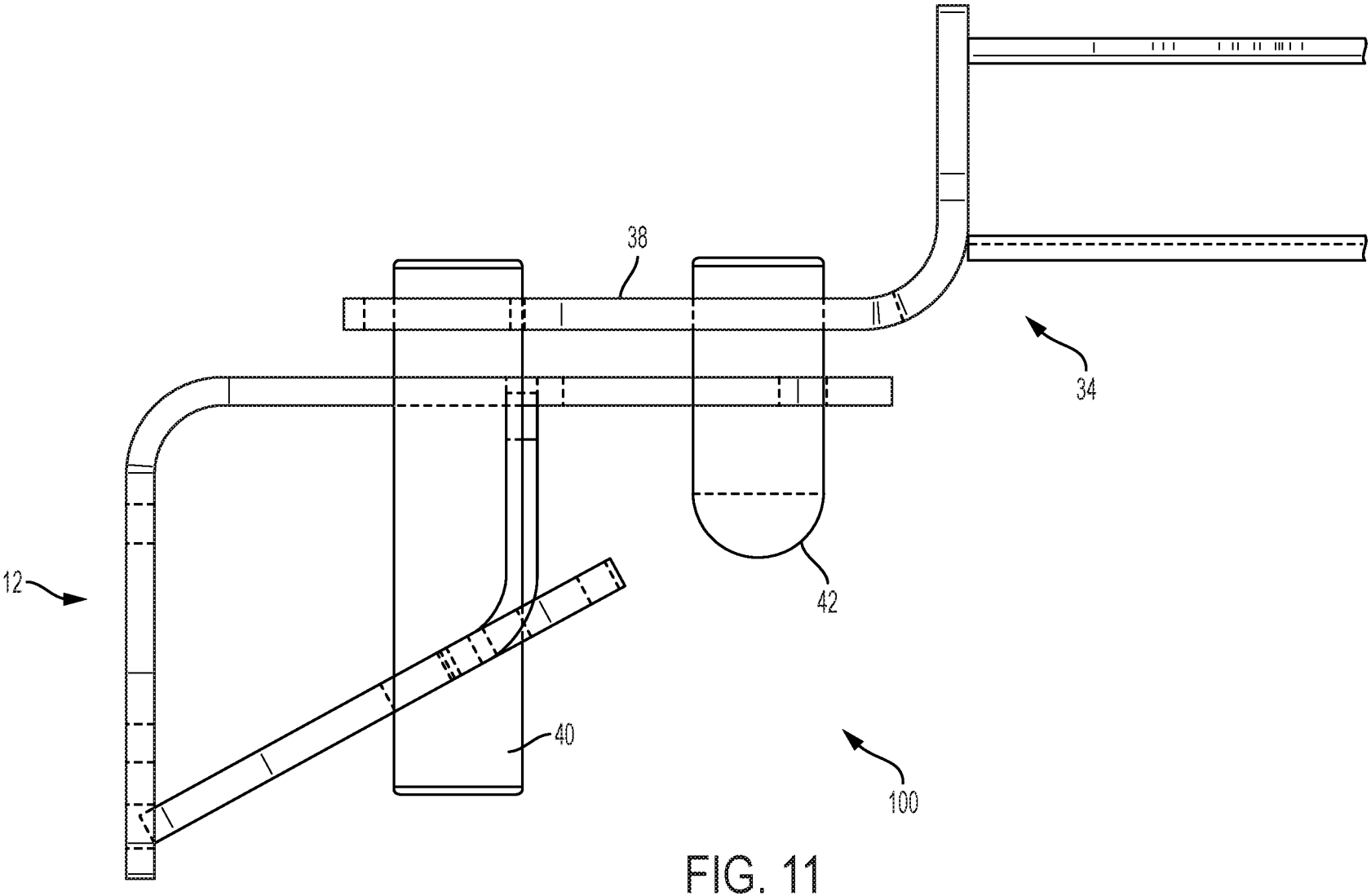
FIG. 11 is a side view of a catch mechanism fully engaged with a receiving bracket according to the present invention.
Figure 12:
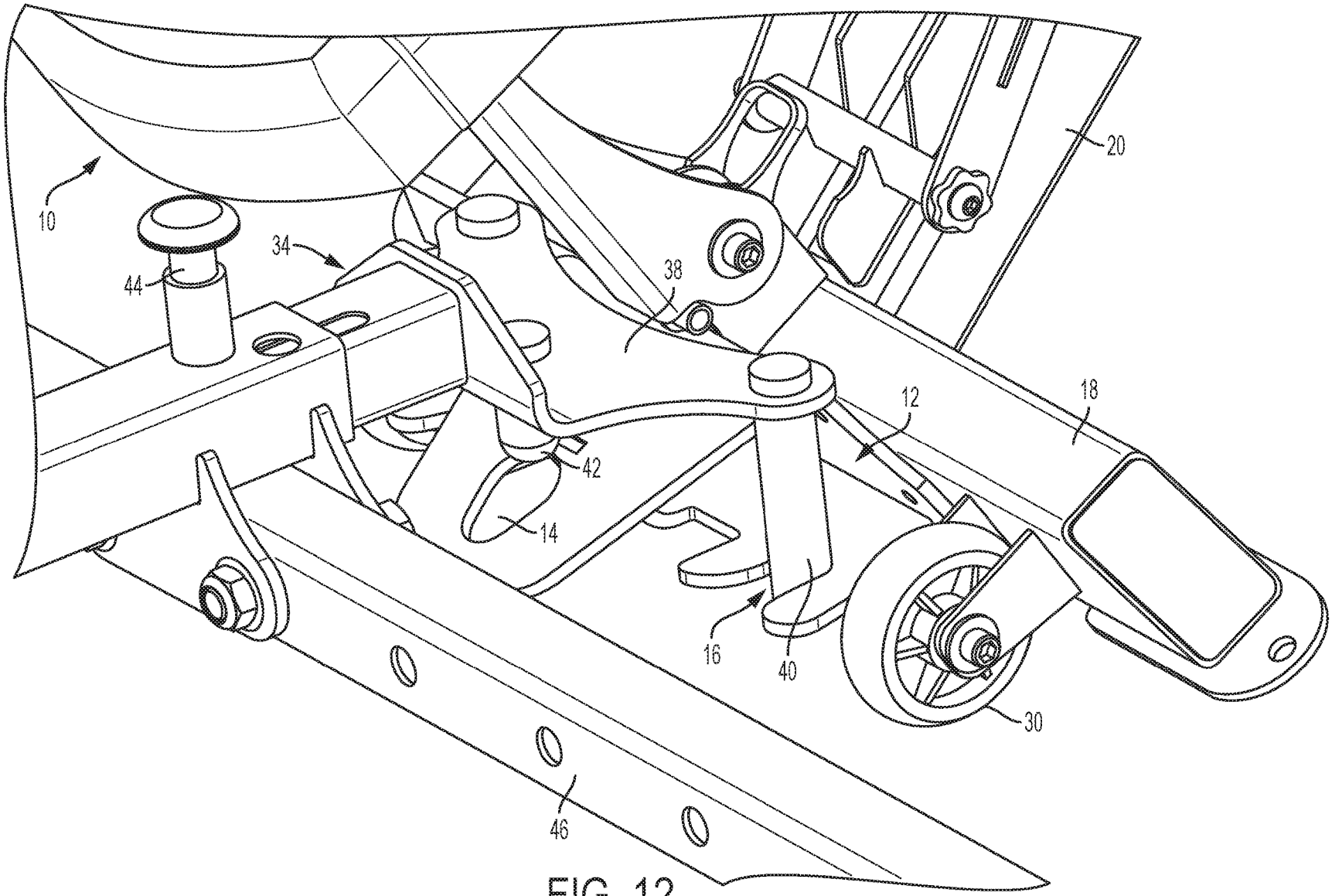
FIG. 12 is a front perspective view of the catch mechanism partially engaged with a receiving bracket.
Figure 13:
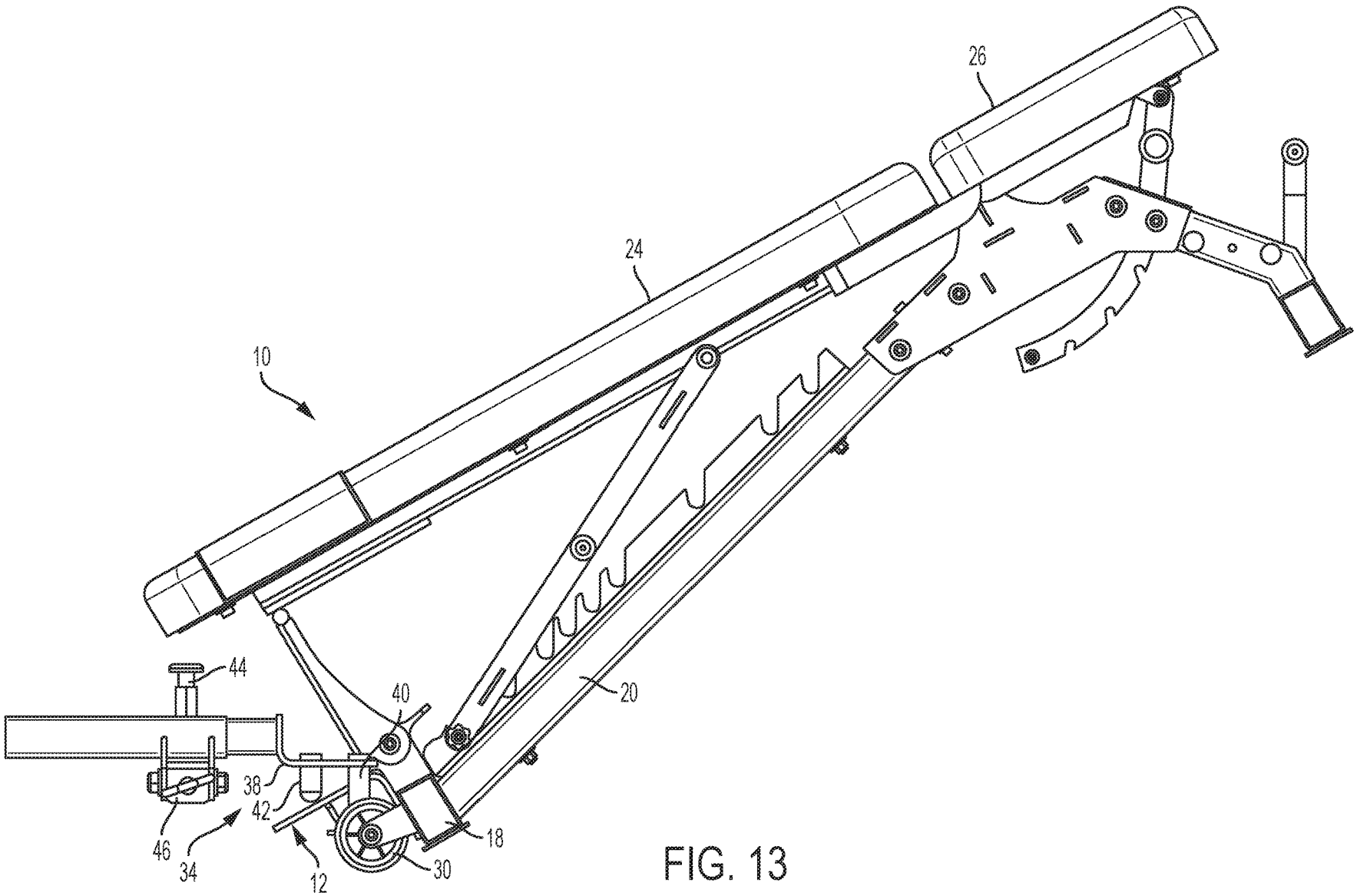
FIG. 13 is a side view of the catch mechanism partially engaged with the receiving bracket of FIG. 12.
Figure 14:
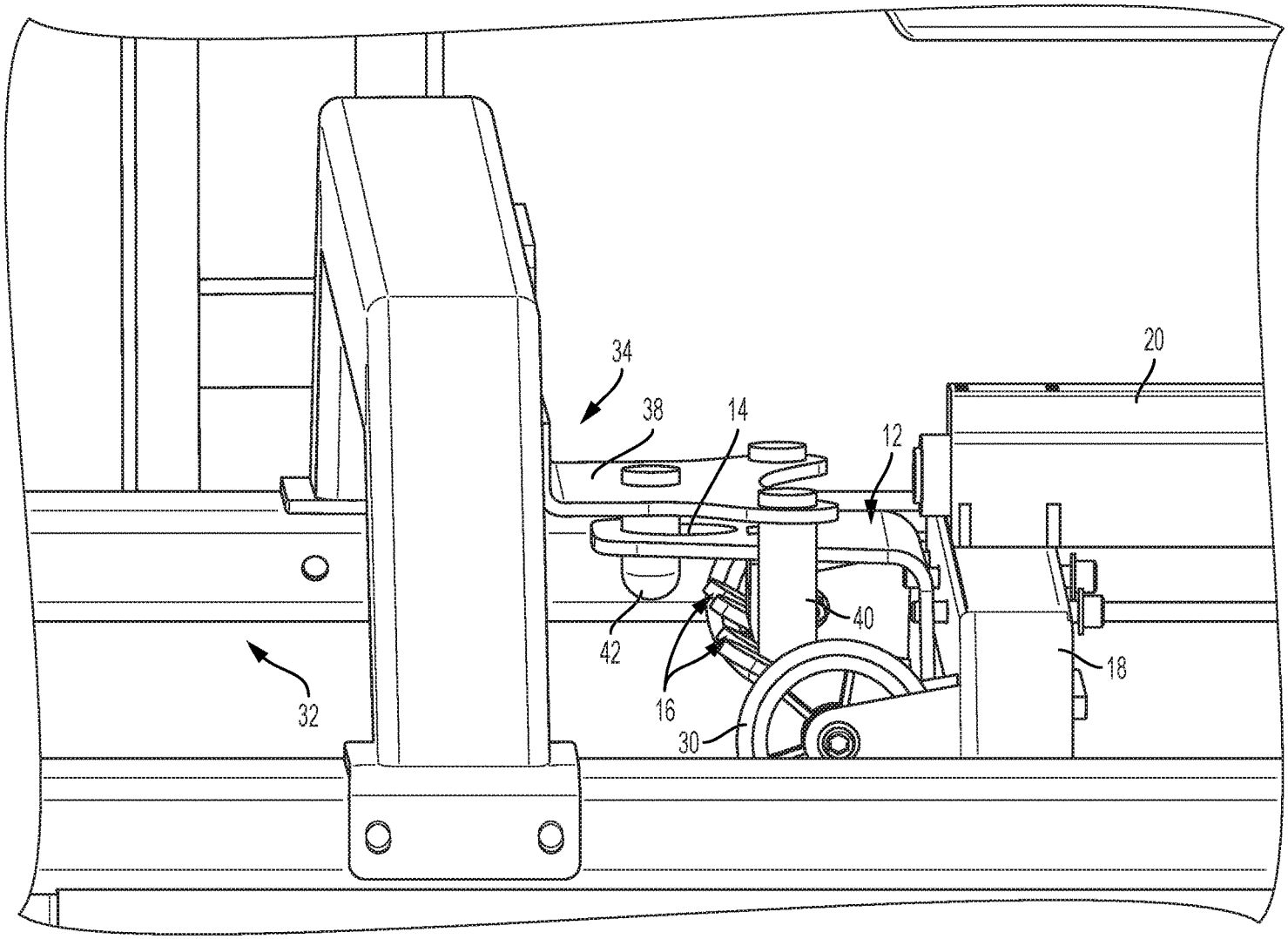
FIG. 14 is a side perspective view of the catch mechanism fully engaged with the receiving bracket of FIG. 13.

FIGS. 10 and 11 show side views of the receiving bracket 12 and the catch mechanism 34 going from the partially engaged position to the fully engaged position. The receiving bracket 12 and the catch mechanism 34 are initially in the partially engaged position. The outside pegs 40 are in the end portion of the receiving slots 16, and the center peg 42 is positioned above the rounded section of the receiving hole 14 closer to the bench unit 10. The bench unit 10 approaches the catch mechanism 34 at an elevated, angled position. The bench unit 10 is moved in the direction of the catch mechanism 34 using the wheels 30. In one embodiment, the bench unit 10 is lifted on an end opposite the receiving bracket 12 so that the wheels 30 proximate the receiving bracket 12 are in contact with the ground. The wheels 30 are then used to move the bench unit 10 towards the catch mechanism 34 to properly align the receiving bracket 12 and the catch mechanism 34. Since the bench unit 10 approaches the catch mechanism 34 at an angle, the receiving bracket 12 also approaches at an angle. Also, the front edge of the two outside pegs 40 and the rounded end of the receiving slots 16 are at the center of the wheel 30, which is the rotational center pivot when the bench unit 10 is rotated down. FIG. 10 shows a side view of the receiving bracket 12 and the catch mechanism 34, but the bench unit 10 is not shown. In FIG. 10, the bench unit 10 (not shown) has been lowered slightly to further engage the receiving bracket 12 and the catch mechanism 34. Because the bench unit 10 has been lowered slightly, the center peg 42 no longer hovers above the receiving hole 14, but is partially inserted into the receiving hole 14. Finally, FIG. 11 shows the receiving bracket 12 and the catch mechanism 34 in the fully engaged position. In FIG. 11, the bench unit 10 (not shown) has been fully lowered, such that the center peg 42 is fully inserted into the receiving hole 14, and the center peg 42 is in contact with the smaller diameter, rounded section of the receiving hole 14 located farther away from the bench unit 10. In other words, as the bench unit 10 is rotated down, the center peg 42 of the catch mechanism 34 and the edge of the receiving hole 14 farther from the bench unit 10 get closer and act as a third point of a clamp. This is because the outside pegs 40 remain in contact with their respective rounded ends of the receiving slots 16.

The bench unit 10 having a receiving bracket 12 is configured to move between a fully disengaged position to a fully engaged position with a catch mechanism 34. In the fully disengaged position, the bench unit 10 is provided at an elevated, angled position being rolled using its wheels 30 towards the catch mechanism 34. The receiving bracket 12 approaches the catch mechanism 34 at an angle. In a partially-engaged position, the bench unit 10 is still at an elevated, angled position. The center peg 42 of the catch mechanism 34 hovers above the angled receiving hole 14 of the angled receiving bracket 12. The two outside pegs 40 and the corresponding receiving slots 16 are used as a guide to correctly align the bench unit 10 with the exercise machine 32. The outside pegs 40 are engaged with their corresponding receiving slots 16, as the outside pegs 40 are in contact with the rounded end portion of each receiving slot 16. The receiving hole 14 begins to encompass the center peg 42 because the bench unit 10, at an angle, is rotated at least partially down. The receiving hole 14 further encompasses the center peg 42 as the bench unit 10 is moved to the fully engaged position, and the center peg 42 simultaneously moves closer to the smaller diameter rounded portion of the receiving hole 14 farther from the bench unit 10. In the fully engaged position, the outside pegs 40 are still in contact with the rounded end of their corresponding receiving slots 16. Further, the center peg 42 is fully inserted into the receiving hole 14 and is in contact with the smaller diameter rounded portion of the receiving hole 14 located farther away from the bench unit 10. In this position, the bench unit 10 has been centered relative to the exercise machine 32 (not shown). In this position, the bench unit 10 has been fully lowered so as to rest the base bar units 18 fully on the ground.

Figure 15:
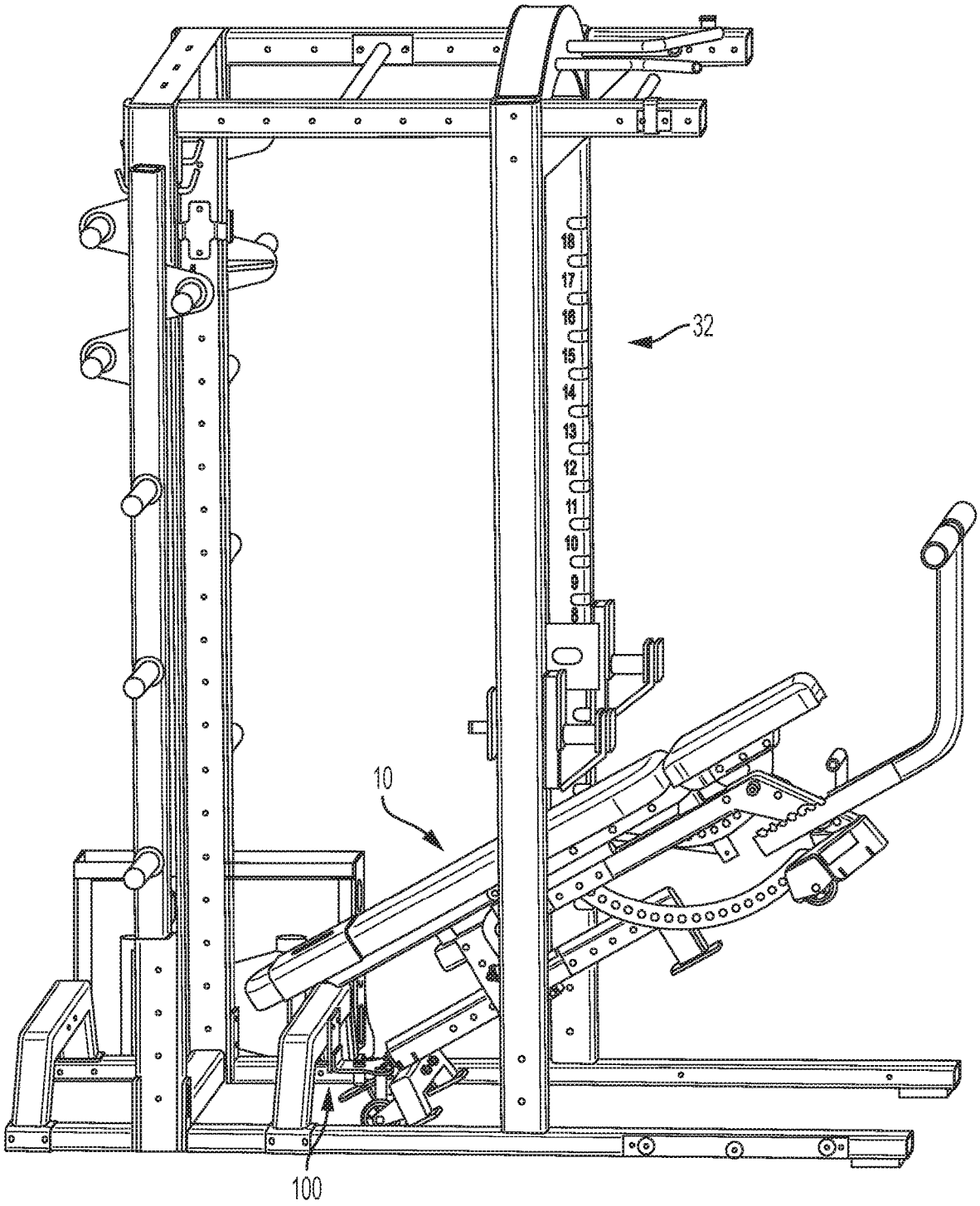
FIG. 15 is a perspective view of a bench unit partially engaged with an exercise machine according to the present invention.
Figure 16:
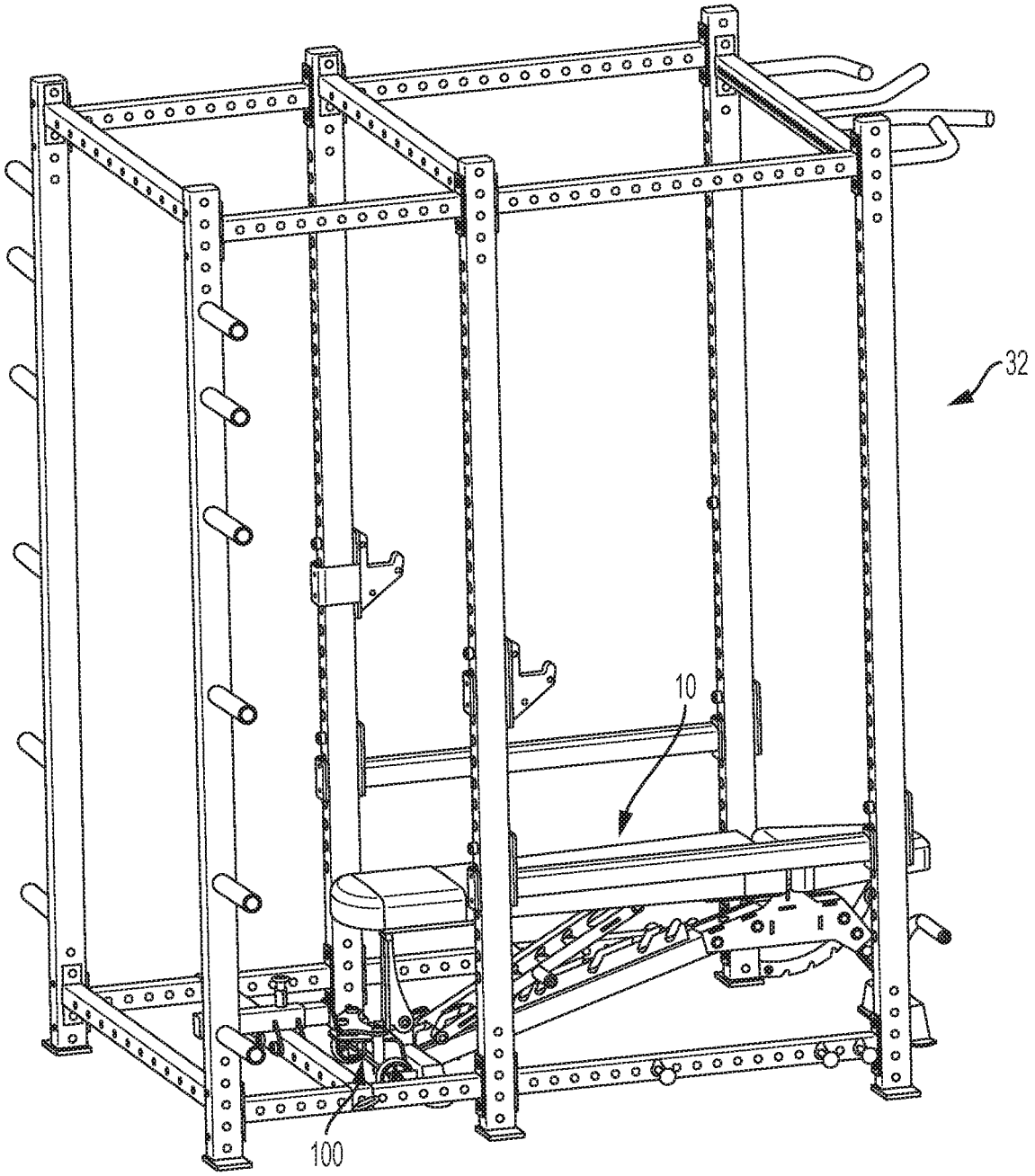
FIG. 16 is a perspective view of a bench unit fully engaged with another exercise machine according to another embodiment of the present invention.

FIGS. 15 and 16 show the bench unit 10 centered or being centered with different exercise machines 32 using the centering device 100. In some embodiments, the exercise machine 32 to which the bench unit 10 is centered is a multi-exercise machine.

In one embodiment, the bench unit 10 can be centered with the exercise machine 32 by aligning the receiving bracket 12 attached to the bench unit 10 with the catch mechanism 34 attached to the exercise machine 32. The bench unit 10 can be rolled using the wheels 30 towards the catch mechanism 34 at an elevated, angled position. The outside pegs 40 of the catch mechanism 34 engage with the receiving slots 16 of the receiving bracket 12 to help properly align the bench unit 10 and the exercise machine 32. Once properly aligned, the bench unit 10 is lowered from the elevated position to engage the receiving bracket 12 and the catch mechanism 34, which further centers the bench unit 10 with the exercise machine 32. When fully engaged, the outside pegs 40 are engaged by their corresponding receiving slots 16, and the center peg 42 is fully engaged with the receiving hole 14. It is contemplated that the receiving bracket 12 could be attached to the exercise machine 32 and the catch mechanism 34 could be attached to the bench unit 10.

In one embodiment, an exercise unit includes a centering device 100, which has a receiving bracket 12 and a catch mechanism 34. The receiving bracket 12 is attached to a bench unit 10 and includes a receiving hole 14 and a plurality of receiving slots 16. The catch mechanism 34 is attached to an exercise machine 32 and has a plurality of outer pegs 40 and a center peg 42. The receiving bracket 12 and catch mechanism 34 of the exercise unit center the bench unit 10 with the exercise machine 32. The catch mechanism 34 is linearly adjustable relative to the exercise machine 32.

Figure 17:
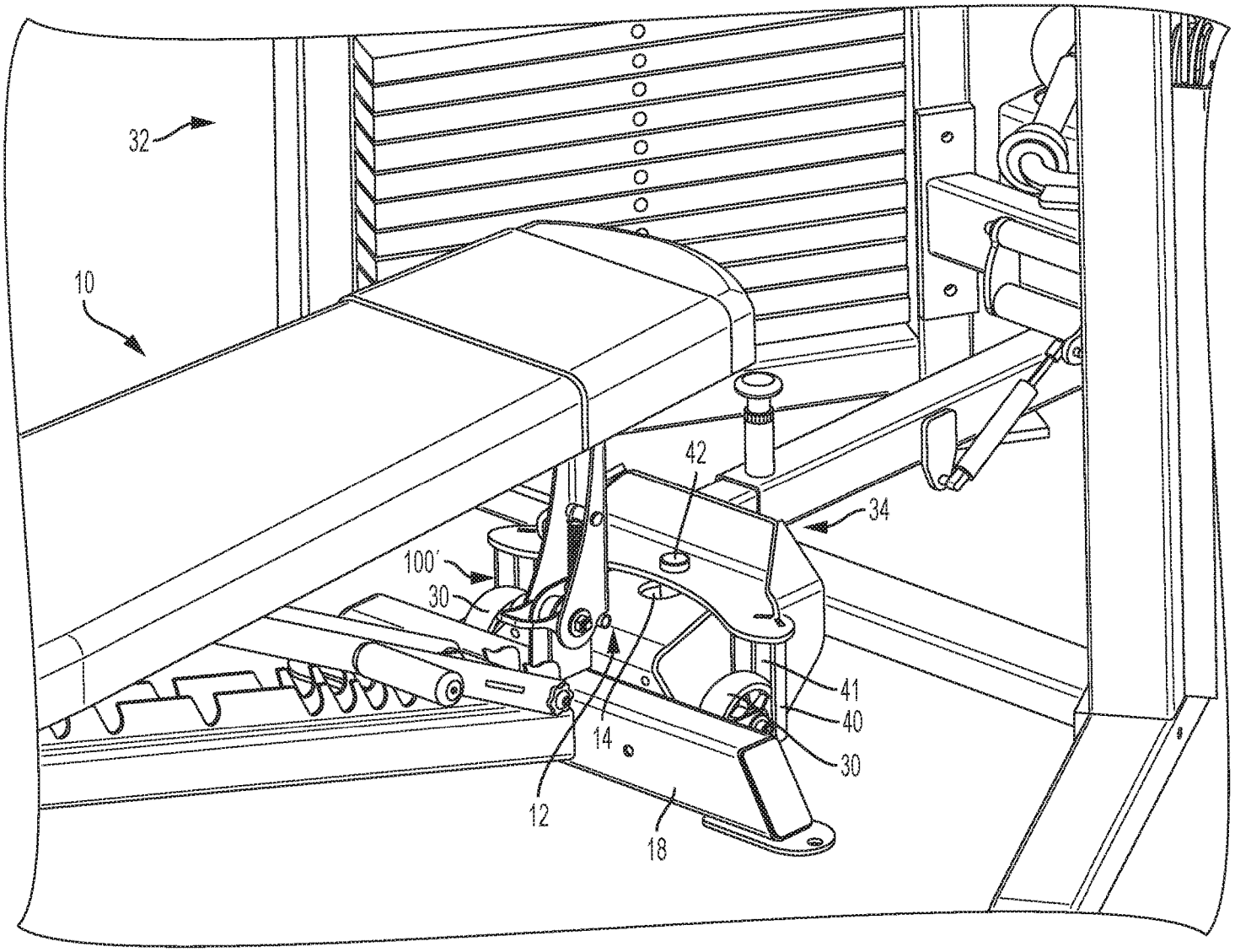
FIG. 17 is a perspective view of a bench unit fully engaged with the exercise machine of FIG. 16.

Referring to FIGS. 17-23, a second embodiment of a centering device 100' includes a bench unit 10 and an exercise machine 32. Attached to the bench unit 10, such as attached to the base bar unit 18 of the bench unit 10, is a receiving bracket 12. In this embodiment, the receiving bracket 12 defines a receiving hole 14. The bench unit 10 also includes wheels 30 attached, for instance, to the base bar unit 18. Attached to the exercise machine 32 is a catch mechanism 34. In this embodiment, the catch mechanism 34 includes a three point clamp 38. The catch mechanism 34 includes a plurality of outside pegs 40. In this embodiment, the outside pegs 40 each define a groove 41. The groove 41 faces a direction away from the exercise machine 32, as shown in FIG. 17, for instance. The catch mechanism 34 further includes a center peg 42. As in previous embodiments, the catch mechanism 34 may be linearly adjustable relative to the exercise machine 32.

As in previously described embodiments, the bench unit 10 can engage the catch mechanism 34 attached to the exercise machine 32 to make the centering device 100'. The center peg 42 is engagable with the receiving hole 14 of the receiving bracket 12, as in previous embodiments. However, in this embodiment, the receiving bracket 12 includes no receiving slots 16. Instead, the wheels 30 of the bench unit 10 are configured to engage the corresponding groove 41 of the corresponding outside peg 40. This is shown clearly, for instance, in FIG. 17.

Figure 18:
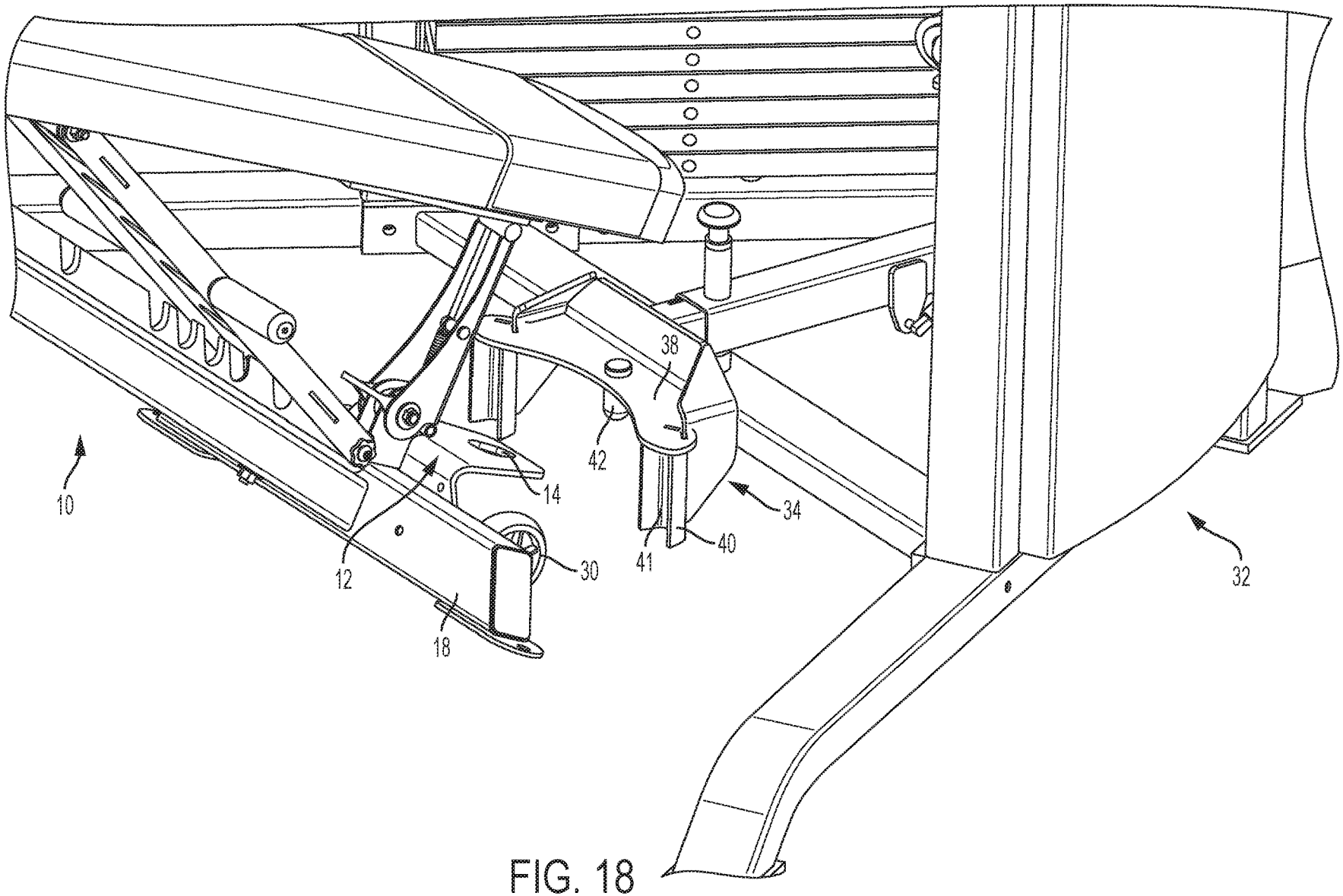
FIG. 18 is a perspective view of the bench unit of FIG. 17 before engaging an exercise machine.
Figure 19:
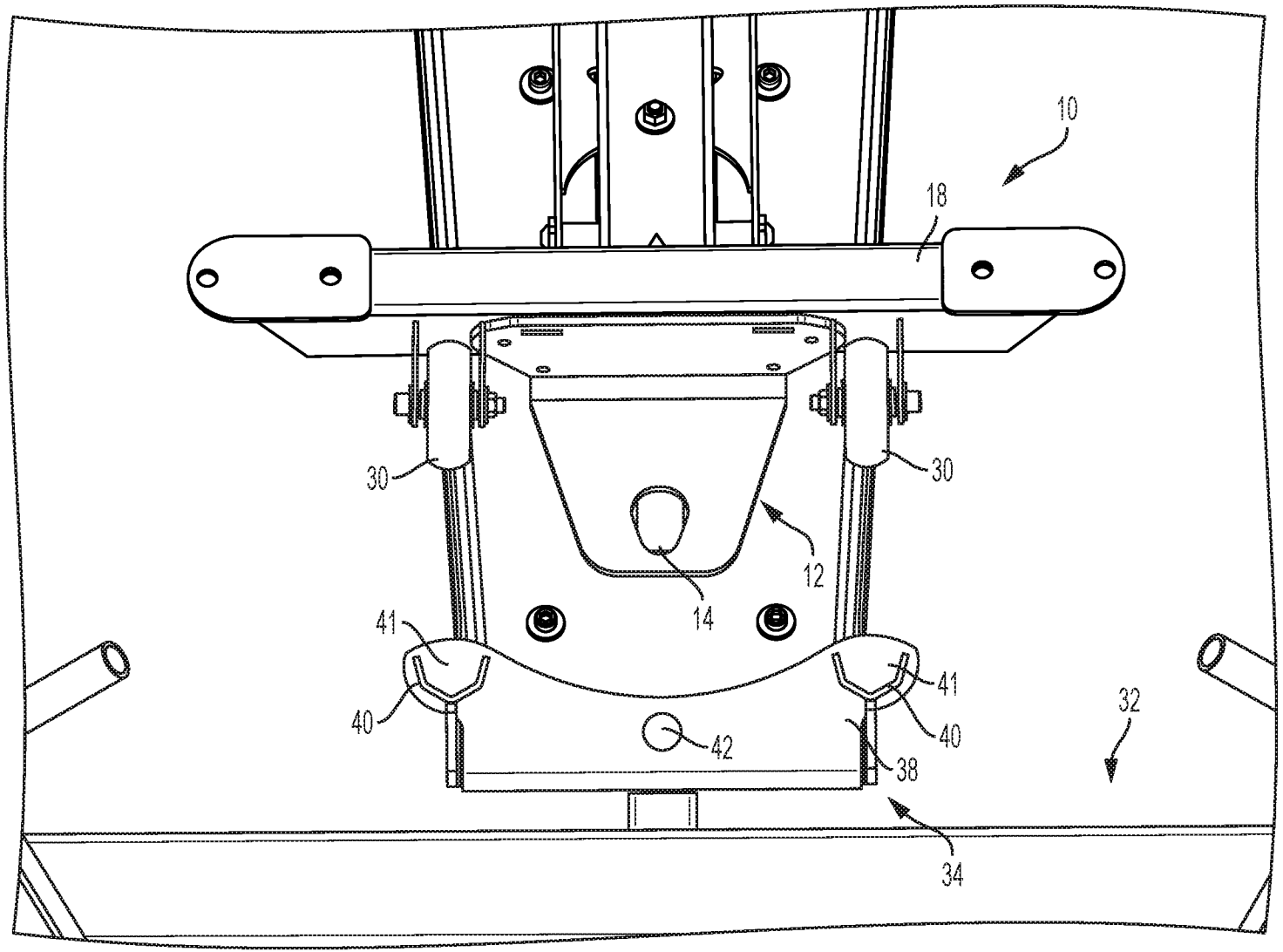
FIG. 19 is a bottom view of the bench unit FIG. 17 before engaging an exercise machine according to the second embodiment of the invention.

FIGS. 18 and 19 show the bench unit 10 before it is engaged with the catch mechanism 34 of the exercise machine 32. Before being engaged, the bench unit 10 approaches (i.e., is rolled towards) the catch mechanism 34 at an elevated, angled position, as shown in FIG. 18. The bench unit 10 is prepared to engage the catch mechanism 34 by lifting the bench unit 10 to the elevated, engaged position and aligning the receiving hole 14 of the receiving bracket 12 with the center peg 42 of the catch mechanism 34 and aligning the wheels 30 of the bench unit 10 with the grooves 41 of the outside pegs 40 of the catch mechanism 34. This alignment is illustrated in FIG. 19.

Figure 20:
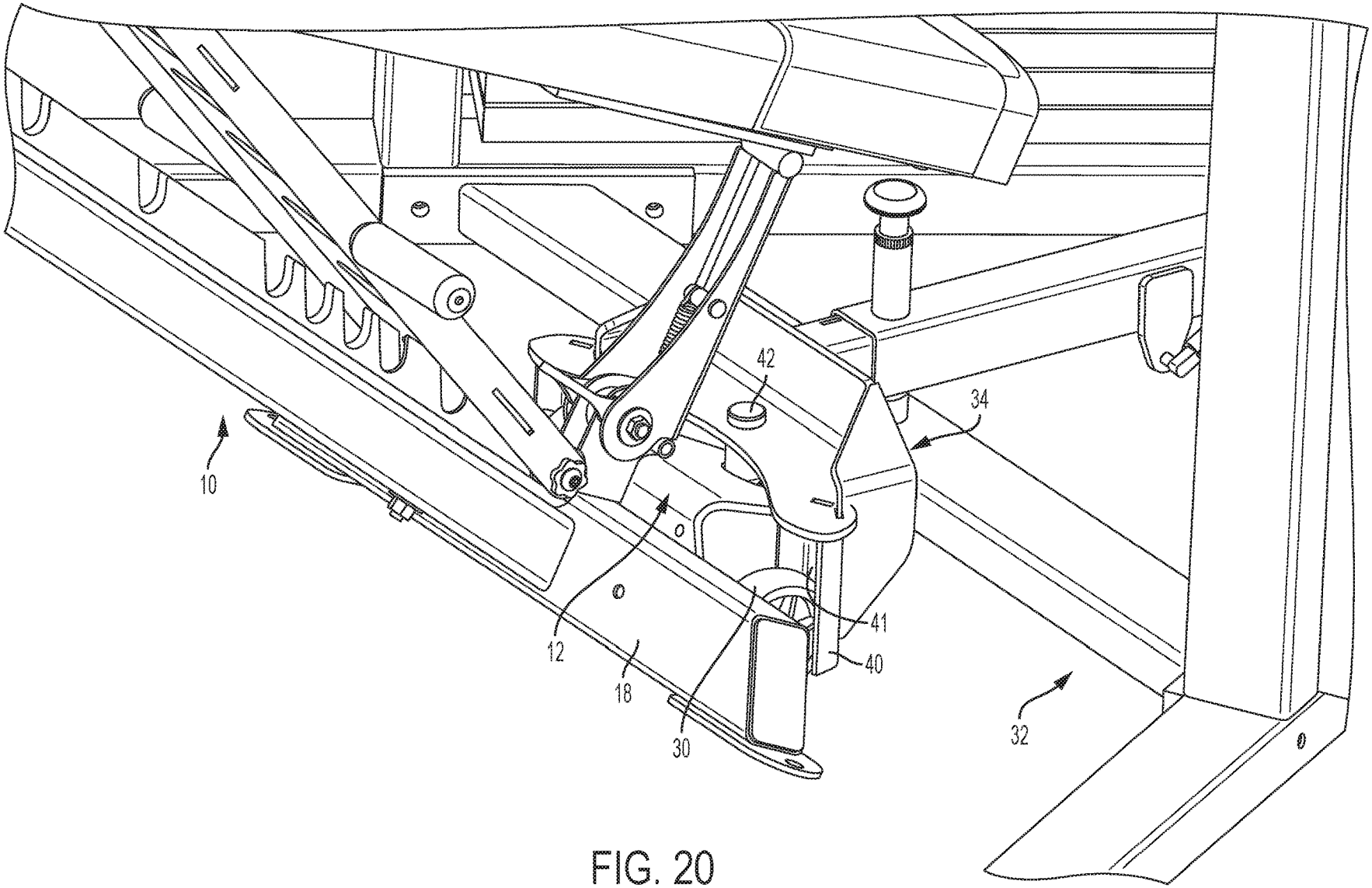
FIG. 20 is a perspective view of the bench unit of FIG. 17 partially engaged with an exercise machine according to the second embodiment of the invention.
Figure 21:
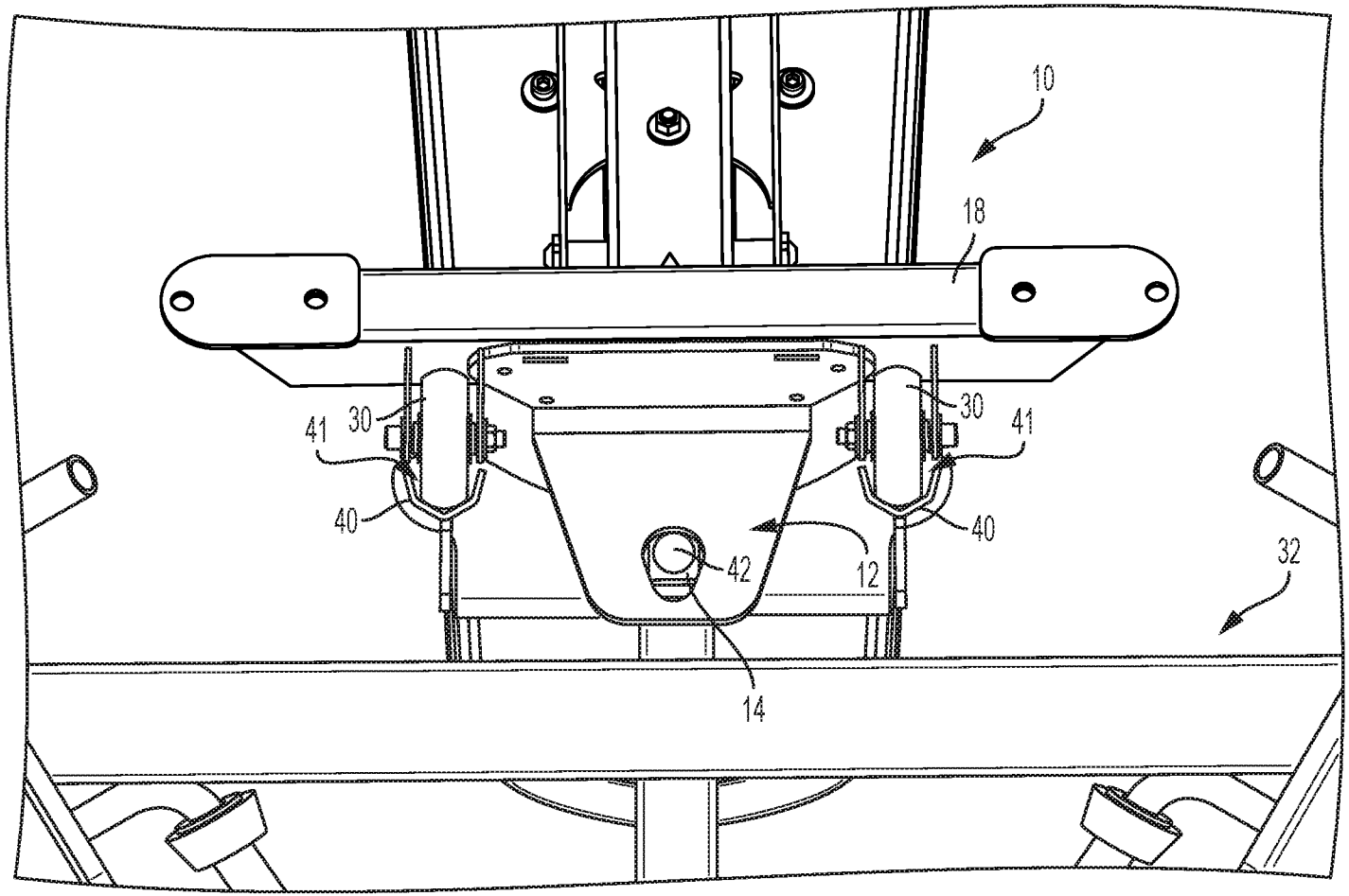
FIG. 21 is a bottom view of the bench unit of FIG. 17 partially engaged with an exercise machine according to a second embodiment of the invention.

FIGS. 20 and 21 show the bench unit 10 partially engaged with the catch mechanism 34 of the exercise machine 32. In this partially engaged position, the bench unit 10 is still in an elevated, angled position, like the position shown in FIG. 20. In the partially engaged position, the wheels 30 are rolled into the grooves 41 of the outside pegs 40 to guide the bench unit 10 to center and align the center peg 42 and receiving hole 14. The center peg 42 starts above the receiving hole 14 in the partially engaged position. As the bench unit 10 is lowered, the center peg 42 penetrates the receiving hole 14, as shown in FIG. 20. As the bench unit 10 is further lowered, the center peg 42 further penetrates the receiving hole 14 and slides toward the smaller, rounded end of the receiving hole 14 closest to the exercise machine 32.

Figure 22:
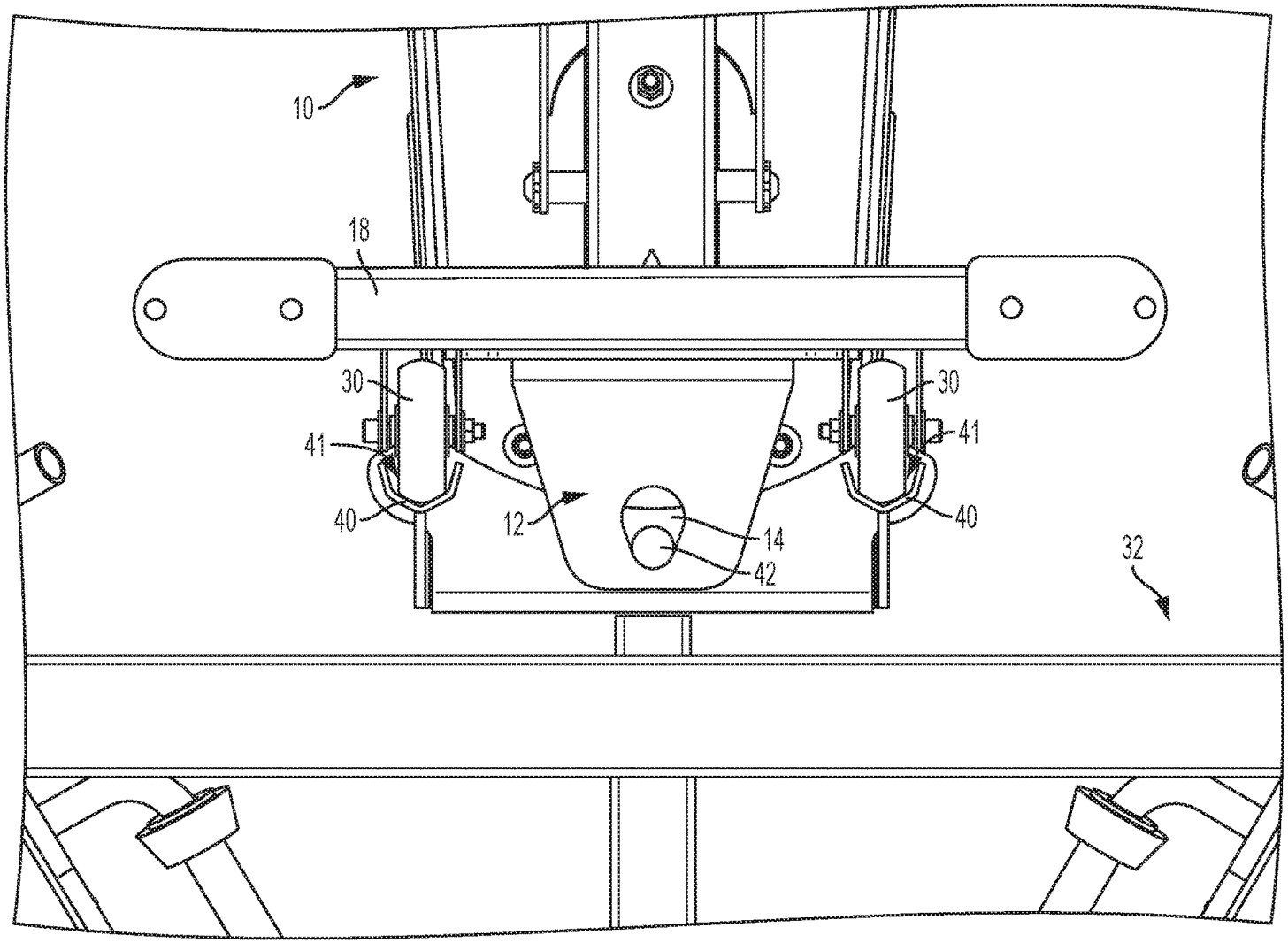
FIG. 22 is a bottom view of the bench unit of FIG. 17 fully engaged with an exercise machine according to the second embodiment of the invention.
Figure 23:
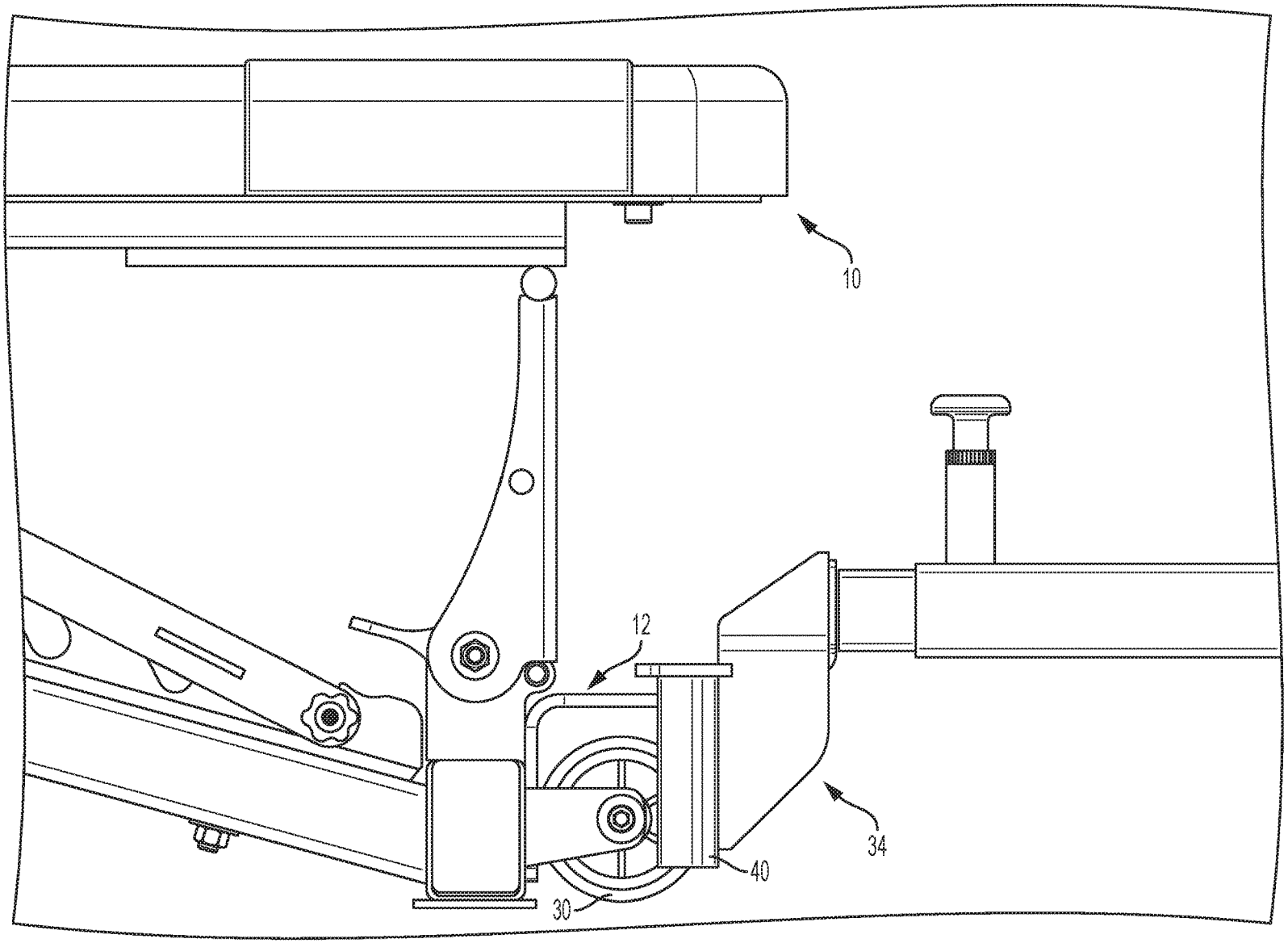
FIG. 23 is a side view of the bench unit of FIG. 17 fully engaged with an exercise machine according to the second embodiment of the invention.

FIGS. 22 and 23 show the bench unit 10 in the fully engaged position. In this position, the bench unit 10 is no longer elevated and angled, and the bench unit 10 rests firmly on the floor, as shown in FIG. 23. The wheels 30 continue to be engaged with the grooves 41 of the outside pegs 40. The center peg 42 is fully engaged with the receiving hole 14 of the receiving bracket 12. In the fully engaged position, the center peg 42 is in contact with the smaller, rounded end of the receiving hole 14 located closest to the exercise machine 32. In the fully engaged position, the bench unit 10 is centered with the exercise machine 32 and is securely engaged with the catch mechanism 34.

In one embodiment, the bench unit 10 can be centered with the exercise machine by aligning the receiving bracket 12 and wheels 30 attached to the bench unit 10 with the catch mechanism 34 attached to the exercise machine 32. The bench unit 10 can be rolled using the wheels 30 towards the catch mechanism 34 at an elevated, angled position. As the wheels 30 are rolled toward the catch mechanism 34, the wheels 30 engage with the grooves 41 of the outside pegs 40 of the catch mechanism 34 to help properly align the bench unit 10 and the exercise machine 32. The bench unit 10 is lowered from the elevated position to engage the receiving hole 14 and the center peg 42, which further centers the bench unit 10 with the exercise machine 32. When fully engaged, the wheels 30 and corresponding grooves 41 of the outside pegs 40 are engaged and the center peg 42 is fully engaged with the receiving hole 14. It is contemplated that the receiving bracket 12 could be attached to the exercise machine 32 and the catch mechanism 34 could be attached to the bench unit 10.

In one embodiment, an exercise unit includes a centering device 100', which has a receiving bracket 12 and a catch mechanism 34. The receiving bracket 12 is attached to a bench unit 10 and includes a receiving hole 14. The bench unit 10 includes wheels 30. The catch mechanism 34 is attached to an exercise machine 32 and has a plurality of outer pegs 40, each defining a groove 41, and the catch mechanism 34 has a center peg 42. The receiving bracket 12, wheels 30, and the catch mechanism 34 of the exercise unit engage to center the bench unit 10 with the exercise machine 32. The catch mechanism 34 may be linearly adjustable relative to the exercise machine 32.

It will be apparent to those skilled in the art that many uses and design variations are possible for the centering device disclosed herein. The foregoing detailed description of various alternative and preferred embodiments will illustrate general principles of the invention, but other embodiments will be apparent to those skilled in the art given the benefits of this disclosure.

The invention claimed is:

1. A centering device comprising:

a receiving bracket configured to be attached to a bench unit, the receiving bracket defining a receiving hole and at least one receiving slot; and a catch mechanism configured to be attached to an exercise machine, the catch mechanism comprising at least one outer peg and a center peg, wherein the receiving bracket and catch mechanism are configured to engage one another to center the bench unit in a left-right direction with respect to a center axis of the exercise machine, and wherein a center axis of the at least one outer peg is positioned laterally from a center axis of the center peg.

2. The centering device of claim 1, wherein the catch mechanism is linearly adjustable relative to the exercise machine.

3. The centering device of claim 1, wherein the at least one receiving slot of the receiving bracket further comprises a second receiving slot.

4. The centering device of claim 3, wherein the receiving slots are defined in opposing ends of the receiving bracket.

5. The centering device of claim 1, wherein the at least one outer peg of the catch mechanism further comprises a second outer peg.

6. The centering device of claim 5, wherein the outer pegs extend from opposing ends of the catch mechanism.

7. The centering device of claim 1, wherein the at least one receiving slot of the receiving bracket includes a chamfered edge to guide the corresponding at least one outer peg of the catch mechanism into the at least one receiving slot.

8. The centering device of claim 1, wherein the at least one receiving slot of the receiving bracket is positioned more proximate to the bench unit than the receiving hole, and wherein the center peg of the catch mechanism is positioned more proximate the exercise machine than the at least one outer peg.

9. The centering device of claim 1, wherein, during engagement of the receiving bracket with the catch mechanism, the at least receiving slot of the receiving bracket is configured to receive the at least one outer peg of the catch mechanism, and the receiving slot of the receiving bracket is configured to receive the center peg of the catch mechanism.

* * * * *